US008951369B2

(12) United States Patent
Maki et al.

(10) Patent No.: US 8,951,369 B2
(45) Date of Patent: Feb. 10, 2015

(54) COPPER ALLOY FOR ELECTRONIC/ELECTRIC DEVICE, COPPER ALLOY THIN PLATE FOR ELECTRONIC/ELECTRIC DEVICE, METHOD OF PRODUCING COPPER ALLOY FOR ELECTRONIC/ELECTRIC DEVICE, CONDUCTIVE COMPONENT FOR ELECTRONIC/ELECTRIC DEVICE AND TERMINAL

(71) Applicants: Mitsubishi Materials Corporation, Tokyo (JP); Mitsubishi Shindoh Co., Ltd., Tokyo (JP)

(72) Inventors: Kazunari Maki, Kitamoto (JP); Hiroyuki Mori, Kitamoto (JP)

(73) Assignees: Mitsubishi Materials Corporation, Tokyo (JP); Mitsubishi Shindoh Co., Ltd., Tokyo (JP)

( * ) Notice: Subject to any disclaimer, the term of this patent is extended or adjusted under 35 U.S.C. 154(b) by 0 days.

(21) Appl. No.: 14/114,862

(22) PCT Filed: Jan. 4, 2013

(86) PCT No.: PCT/JP2013/050004
§ 371 (c)(1),
(2) Date: Nov. 15, 2013

(87) PCT Pub. No.: WO2013/103149
PCT Pub. Date: Jul. 11, 2013

(65) Prior Publication Data

US 2014/0087606 A1 Mar. 27, 2014

(30) Foreign Application Priority Data

Jan. 6, 2012 (JP) ..... 2012-001177
Sep. 14, 2012 (JP) ..... 2012-203517

(51) Int. Cl.

| | |
|---|---|
| ***C22C 9/04*** | (2006.01) |
| ***C22F 1/08*** | (2006.01) |
| ***H01R 9/24*** | (2006.01) |
| ***H01B 1/02*** | (2006.01) |
| ***H01R 13/03*** | (2006.01) |

(52) U.S. Cl.
CPC *H01R 13/03* (2013.01); *C22C 9/04* (2013.01); *C22F 1/08* (2013.01); *H01B 1/026* (2013.01)
USPC ..... 148/412; 148/685; 439/887

(58) Field of Classification Search
CPC ..... C22C 9/04; H01R 13/03; C22F 1/08; H01B 1/026
USPC ..... 148/685, 412; 439/887
See application file for complete search history.

(56) References Cited

U.S. PATENT DOCUMENTS

| | | | | |
|---|---|---|---|---|
| 5,893,953 | A | 4/1999 | Bhargava | |
| 6,099,663 | A | 8/2000 | Bhargava | |
| 6,471,792 | B1 | 10/2002 | Breedis et al. | |
| 6,679,956 | B2 | 1/2004 | Bhargava | |
| 6,695,934 | B1 | 2/2004 | Bhargava | |
| 2002/0159912 | A1 * | 10/2002 | Oishi | 420/477 |
| 2009/0101243 | A1 * | 4/2009 | Aruga et al. | 148/412 |

FOREIGN PATENT DOCUMENTS

| | | | |
|---|---|---|---|
| JP | 05-033087 | A | 2/1993 |
| JP | 06-184679 | A | 7/1994 |
| JP | 2000-178670 | A | 6/2000 |
| JP | 2001-303159 | A | 10/2001 |
| JP | 2002-003966 | A | 1/2002 |
| JP | 2002-530523 | A | 9/2002 |
| JP | 2003-306732 | A | 10/2003 |
| JP | 2005-029826 | A | 2/2005 |
| JP | 2005-060773 | A | 3/2005 |
| JP | 3717321 | B | 11/2005 |
| JP | 2006-283060 | A | 10/2006 |
| JP | 2007-084920 | A | 4/2007 |
| JP | 3953357 | B | 8/2007 |
| JP | 2011-184775 | A | 9/2011 |
| JP | 2013-007062 | A | 1/2013 |
| WO | WO-2010/134210 | A1 | 11/2010 |
| WO | WO-2012/026610 | A1 | 3/2012 |
| WO | WO-2012/096237 | A1 | 7/2012 |
| WO | WO-2013/103149 | A1 | 7/2013 |

OTHER PUBLICATIONS

Lee, Anthony, and Michael Mamrick. "Fretting corrosion of tin-plated copper alloy." Components, Hybrids, and Manufacturing Technology, IEEE Transactions on 10.1 (1987): 63-67.*
International Search Report mailed Mar. 12, 2013 for the corresponding PCT Application No. PCT/JP2013/050004.
International Search Report mailed Apr. 3, 2012 for the related PCT Application No. PCT/JP2012/050201.
International Search Report mailed Aug. 6, 2013 for the related PCT Application No. PCT/JP2013/067814.
International Search Report mailed Aug. 6, 2013 for the related Application No. PCT/JP2013/067863.
International Search Report mailed Sep. 3, 2013 for the related PCT Application No. PCT/JP2013/068834.
* cited by examiner

*Primary Examiner* — Jessee Roe
(74) *Attorney, Agent, or Firm* — Leason Ellis L.L.P.

(57) ABSTRACT

What is provided is a copper alloy for electronic/electric device comprising: in mass %, more than 2% and 36.5% or less of Zn; 0.1% or more and 0.9% or less of Sn; 0.05% or more and less than 1.0% of Ni; 0.001% or more and less than 0.10% of Fe; 0.005% or more and 0.10% or less of P; and the balance Cu and inevitable impurities, wherein a content ratio of Fe to Ni, Fe/Ni satisfies $0.002 \leq Fe/Ni < 1.5$, a content ratio of a sum of Ni and Fe, (Ni+Fe), to P satisfies $3 < (Ni+Fe)/P < 15$, a content ratio of Sn to a sum of Ni and Fe, (Ni+Fe) satisfies $0.3 < Sn/(Ni+Fe) < 5$, an average crystal grain diameter of α phase containing Cu, Zn, and Sn is in a range of 0.1 to 50 μm, and the copper alloy includes a precipitate containing P and one or more elements selected from Fe and Ni.

28 Claims, 4 Drawing Sheets

×150, 000

×750, 000

×500, 000

COPPER ALLOY FOR ELECTRONIC/ELECTRIC DEVICE, COPPER ALLOY THIN PLATE FOR ELECTRONIC/ELECTRIC DEVICE, METHOD OF PRODUCING COPPER ALLOY FOR ELECTRONIC/ELECTRIC DEVICE, CONDUCTIVE COMPONENT FOR ELECTRONIC/ELECTRIC DEVICE AND TERMINAL

CROSS-REFERENCE TO RELATED PATENT APPLICATIONS

This application is a U.S. National Phase Application under 35 U.S.C. §371 of International Patent Application No. PCT/JP2013/050004, filed Jan. 4, 2013, and claims the benefit of Japanese Patent Application Nos. 2012-001177, filed on Jan. 6, 2012 and 2012-203517, filed Sep. 14, 2012, all of which are incorporated by reference in their entirety herein. The International Application was published in Japanese on Jul. 11, 2013 as International Publication No. WO/2013/103149 under PCT Article 21(2).

FIELD OF THE INVENTION

The present invention relates to a copper alloy that is used as a conductive component of electronic/electric device (electronic and/or electric device (EE device)), for example, in a form of a connector of semiconductor device, a terminal of other equipment, movable conductive piece of electromagnetic relays, lead frame or the like. Specifically, the present invention relates to a Cu—Zn—Sn based copper alloy, that is, Sn-added brass (Cu—Zn alloy) based alloy for EE device, its application in a copper alloy thin plate for EE device, a method of producing a copper alloy for EE device, conductive components for EE device and terminals.

BACKGROUND OF THE INVENTION

Copper or copper alloy are applied in conductive components of EE device such as terminals, for example, connectors of semiconductor device, or movable conductive piece of electromagnetic relays. Specifically, brass (Cu—Zn alloy) has been widely used in the prior arts based on the consideration of a balance between strength, workability, cost or the like. Where the copper alloy is used in terminals such as connectors, surface of a Cu—Zn substrate (raw plate) is plated with tin (Sn) in many case with a main purpose of enhancing reliability of connection with a conductive member of the mating part.

In a conductive component such as connectors of the above-described constitution formed by plating Sn on the surface of the Cu—Zn alloy substrate, the Cu—Zn based alloy of the substrate is sometimes added with Sn and is used in the form of Cu—Zn—Sn based alloy so as to improve recycling efficiency and to improve the strength of the alloy.

In general, the production process of conductive component of EE device such as a connector of a semiconductor includes rolling the raw material copper alloy to form a thin plate (strip) having a thickness of about 0.05 to 1.0 mm, obtaining a member of a predetermined shape by blanking (stamping), and bending at least a partial portion of the stamped member. In many cases, in the usage of the thus formed conductive component, electric connection with the mating conductive member is achieved by making the vicinity of the bent portion of the conductive component contact the mating conductive member, and the contacting sate with the mating conductive member is maintained by spring property of the bent portion. In the copper alloy used in the conductive components such as connectors, excellent conductivity is required so as to suppress heat generation due to resistance heating. In addition, high strength and excellent rollability and blanking quality are required since the alloy is rolled to a thin plate (strip) and is subjected to blanking. Further, in the case of a connector that is formed by bending a copper alloy such that the vicinity of the bent portion is used to maintain contact state with the mating member by spring property of the bent portion, excellent stress relaxation resistance (SR resistance) is required for the copper alloy member in addition to the requirements for excellent bendability such that the contact state with the mating member in the vicinity of the bent portion is maintained satisfactorily for a long time (or even in high temperature atmosphere). That is, in the case of a terminal such as a connector that utilizes spring property of a bent portion for maintaining contact state with the mating member, contact pressure with the mating member is not maintained sufficiently resulting in tendency to occur defective contact in the early stage where the copper alloy has inferior stress relaxation resistance and time dependent relaxation of residual strain occurs in the bent portion or the residual strain in the bent portion is relaxed under a high temperature environment.

For example, Patent literatures 1 to 3 describe conventional arts which have been proposed as a solution for improving SR resistance of Cu—Zn—Sn based ally used in conductive components such as connectors. Patent literature 4 proposes a solution for improving SR resistance of Cu—Zn—Sn based alloy for lead frame.

Patent literature 1 describes improvement of SR resistance by making the Cu—Zn—Sn based alloy contain Ni, and thereby generating Ni—P based compounds. Patent literature 1 also shows that addition of Fe also improves the SR resistance. In the proposal described in Patent literature 2, strength, elasticity, and heat resistance of the alloy are improved by adding Ni and Fe with P to Cu—Zn—Sn based alloy. Even though SR resistance is not directly described in Patent literature 2, it is considered that the improvement of strength, elasticity, and heat resistance means the improvement of SR resistance.

The inventors also confirmed that the addition of Ni, Fe, and P to the Cu—Zn—Sn based alloy as proposed in Patent literatures 1, 2 is effective in improvement of SR resistance of the alloy. However, the proposals of Patent literatures 1 and 2 merely consider individual amount of each of Ni, Fe, and P. As a result of Inventors' experiments and research, it was made clear that the SR resistance cannot be always improved securely and sufficiently only by the control of the individual contents of these elements.

On the other hand, the proposal of Patent literature 3 describes that the SR resistance is improved by adding Ni to Cu—Zn—Sn based alloy and controlling Ni/Sn ratio to be within a certain range. Patent literature 3 also describes that the addition of small amount of F is also effective in improvement of SR resistance.

Even though the control of Ni/Sn ratio described in Patent literature 3 is indeed effective in improvement of SR resistance, Patent literature 3 describes nothing about a relationship between the P compounds and the SR resistance. As described in Patent literatures 1 and 2, P compounds may have strong influence on the SR resistance. In the proposal of Patent literature 3, nothing is considered about the relationship between the SR resistance and contents of elements such as Fe and Ni that constitute P compounds. The experimental study by the inventors also made clear that sufficient and secure improvement of SR resistance could not be achieved only by a constitution in accordance with Patent literature 3.

Patent literature 4 related to a lead frame describes that improvement of SR resistance is enabled by adding Ni and Fe with P to Cu—Zn—Sn based alloy and simultaneously controlling atomic ratio of (Fe+Ni)/P to be within the range of 0.2 to 3, and thereby generating Fe—P based compounds, Ni—P based compounds, or Fe—Ni—P based compounds.

However, as a result of experimental study by the inventors, it was made clear that sufficient improvement of SR resistance cannot be obtained only by the control of the total amount of Fe, Ni, P and atomic ratio of (Fe+Ni)/P as described in Patent literature 4. Although exact reason is not clear, as a result of experiments and research by the inventors, it was made clear that control of Fe/Ni ratio and Sn/(Ni+Fe) ratio is important in addition to control of total amount of Fe, Ni, and P and (Fe+Ni)/P ratio and that SR resistance cannot be improves securely and sufficiently without controlling these content ratios with appropriate balance.

As explained above, in accordance with the conventional arts that have been proposed for improving SR resistance of Cu—Zn—Sn based copper alloy for conductive components of EE device, effect of improving SR resistance is not yet secure and sufficient, and further improvement is demanded. In the component such as a connector that has a bent portion formed by bending a thin plate of rolled copper alloy, and is use such that the vicinity of the bent portion is made contact with the mating member, and the contact state with the mating member is maintained by spring property of the bent portion, defective phenomena such as defective contact may tend to occur in the early stage if the contact pressure with the mating member is not maintained as a result of relaxation of residual strain over time or under high temperature environment. To avoid such a problem, large thickness of material has been required in the conventional arts, resulting in increase of raw material cost, and increase of weight of the component.

RELATED ART DOCUMENT

Patent Literature

Patent Literature 1: Japanese Unexamined Patent Application, First Publication No. H05-33087.

Patent Literature 2: Japanese Unexamined Patent Application, First Publication No. 2006-283060.

Patent Literature 3: Japanese Patent (Granted) Publication No. 3953357

Patent Literature 4: Japanese Patent (Granted) Publication No. 3717321

SUMMARY OF THE INVENTION

Problems to be Solved by the Invention

As explained above, conventional Cu—Zn—Sn based alloys used as a substrate of Sn plated brass strip does not yet has sufficient and secure SR resistance as a material for thin plate (strip) that is subjected to bending such that contact with the mating conductive member is obtained in the vicinity of the bent portion, and further secure and sufficient improvement of SR resistance is strongly demanded.

Based on the above-described circumstance, an object of the present invention is to provide a copper alloy for EE device, a copper alloy thin plate for EE device utilizing the same alloy, a method of producing a copper alloy for EE device, conductive component for EE device and terminals, the copper alloy having secure and sufficient SR resistance as a copper alloy, specifically a Cu—Zn—Sn based copper alloy, applied as conductive components for EE device such as connectors, other terminals, movable conductive piece of electromagnetic relays, and lead frames, the copper alloy being capable of having smaller thickness as a component material than the conventional alloy, having high strength, and having excellent properties such as bendability and conductivity.

Means for Solving the Problems

As a result of extensive experiments and research by the inventors for solving the above-described problems, the following findings were obtained. That is, it is important not only to add appropriate amounts of nickel (Ni) and iron (Fe) and to add appropriate amount of phosphorus (P) to the Cu—Zn—Sn based alloy while controlling individual amount of each alloying elements, but also to control relative ratio of Ni, Fe, P, and Sn in the alloy, specifically Fe/Ni that shows a ratio of Fe content and Ni content, (Ni+Fe)/P that shows a ratio of total content (Ni+Fe) of Ni and Fe and P content, and Sn/(Ni+Fe) that shows a ratio of Sn content and total content (Ni+Fe) of Ni and Fe to be in appropriate ranges by atomic ratio. By the above-described regulation of the alloying elements, precipitates containing Ni and/or Fe and P are generated appropriately, and the crystal grain diameter of matrix material (a phase main body) is controlled appropriately. As a result, it is possible to achieve a copper alloy that is provided with securely and sufficiently improved SR resistance and is provided with improved strength, and that has excellent properties such as bendability and conductivity that are required for connectors or other terminals, movable conductive piece of electromagnetic relays, and lead frame or the like. The present invention was made based on the above-described findings.

Further, the inventors found that SR resistance of the alloy could be further improved by adding appropriate amount of Co simultaneously with the above-described Ni, Fe, and P.

The basic (first) aspect of the present invention is a copper alloy for electronic/electric device including: in mass %, more than 2.0% and 36.5% or less of Zn; 0.1% or more and 0.9% or less of Sn; 0.05% or more and less than 1.0% of Ni; 0.001% or more and less than 0.10% of Fe; 0.005% or more and 0.10% or less of P; and the balance Cu and inevitable impurities, wherein a content ratio of Fe to Ni, Fe/Ni, in atomic ratio satisfies $0.002<Fe/Ni<1.5$, a content ratio of a sum of Ni and Fe, (Ni+Fe), to P, in atomic ratio satisfies $3<(Ni+Fe)/P<15$, a content ratio of Sn to a sum of Ni and Fe, (Ni+Fe), in atomic ratios satisfies $0.3<Sn/(Ni+Fe)<5$, an average crystal grain diameter of $\alpha$ phase containing Cu, Zn, and Sn is in a range of 0.1 to 50 μm, and the copper alloy includes a precipitate containing P and one or more elements selected from Fe and Ni.

According to the above-described basic aspect of the present invention, Cu—Zn—Sn-based alloy having a microstructure with an appropriate amount of precipitates, which are precipitated from the matrix (mainly $\alpha$ phase) and include P and one or more selected from Fe and Ni, can be obtained by adding appropriate amounts of P and one or more selected from Ni and Fe simultaneously in addition to an appropriate amount of Sn, and controlling addition ratios among each of Sn, Ni, Fe, and P appropriately. The precipitates including P and one or more selected from Fe and Ni are referred [Ni, Fe]—P-based precipitates, hereinafter. When the average crystal grain diameter of the matrix $\alpha$ phase is adjusted in the range of 0.1 to 50 μm at the same time in the Cu—Zn—Sn-based alloy that has an appropriate amount of the [Ni, Fe]—

P-based precipitates, sufficiently excellent anti-stress relaxation (anti-SR) characteristic, high strength (proof stress), and other excellent properties such as conductivity can be obtained. In many occasions, SR resistance cannot be improved sufficiently by simply adjusting individual content amounts of Sn, Ni, Fe, and P in predetermined ranges depending on the contents of these elements in a working material. Also, the other properties can be insufficient. According to the present invention, SR resistance can be sufficiently improved reliably and a satisfactory strength (proof stress) can be obtained at the same time by controlling the relative content ratios of these elements in the ranges defined by each of above-described formulae.

Here, the [Ni, Fe]—P-based precipitates mean Ni—Fe—P ternary based precipitates or Fe—P or Ni—P binary based precipitates. The [Ni, Fe]—P-based precipitates also could mean multicomponent precipitates including other elements, such as Cu, Zn, and Sn as major components, and O, S, C, Co, Cr, Mo, Mg, Mn, Zr, Ti, or the like as impurities, in addition to the above-mentioned major elements. The [Ni, Fe]—P-based precipitates exist I a form of an alloy dissolving a phosphide or phosphorous.

A copper alloy for EE device according to the second aspect of the present invention is the copper alloy for EE device according to the copper alloy of the first aspect, wherein an average grain diameter of the precipitate containing P and one or more elements selected from Fe and Ni is 100 nm or less.

SR resistance can be sufficiently improved more reliably and a more satisfactory strength (proof stress) can be obtained at the same time by controlling the average grain diameter of the precipitate to be 100 nm or less A copper alloy for EE device according to the third aspect of the present invention is the copper alloy for EE device according to the copper alloy of the above-described second aspect, wherein a precipitation density of the precipitate containing P and one or more elements selected from Fe and Ni and having the average grain diameter of 100 nm or less is in a range of 0.001 to 1.0% in volume ratio.

Adjusting the precipitation density of the precipitate containing P and one or more elements selected from Fe and Ni and having the average grain diameter of 100 nm or less in the range of 0.001 to 1.0% in volume ratio also contributes to improvement of SR resistance and strength of the alloy.

A copper alloy for EE device according to the fourth aspect of the present invention is the copper alloy according to the above-described first aspect, wherein the precipitate containing P and one or more elements selected from Fe and Ni has a crystal structure of $Fe_2P$-based crystal or $Ni_2P$-based crystal structure.

According to the detailed experiments and research by the inventors, it was found that presence of precipitates having hexagonal crystal structure of $Fe_2P$ system or $Ni_2P$ system or orthorhombic crystal structure of $Fe_2P$ system contributes the strength improvement of the alloy through SR resistance improvement and miniaturization of crystal grains in the above-described precipitates containing P and one or more selected from Fe and Ni.

A copper alloy for EE device according to the fifth aspect of the present invention is a copper alloy for electronic/electric device including: in mass %, more than 2% and 36.5% or less of Zn; 0.1% or more and 0.9% or less of Sn; 0.05% or more and less than 1.0% of Ni; 0.001% or more and less than 0.10% of Fe; 0.001% or more and less than 0.10% of Co; 0.005% or more and 0.10% or less of P; and the balance Cu and inevitable impurities, wherein a content ratio of a sum of Fe and Co, (Fe+Co), to Ni, (Fe+Co)/Ni, in atomic ratio satisfies $0.002 \leq (Fe+Co)/Ni < 1.5$, a content ratio of a sum of Ni, Fe, and Co, (Ni+Fe+Co), to P, in atomic ratio satisfies $3 < (Ni+Fe+Co)/P < 15$, a content ratio of Sn to a sum of Ni, Fe, and Co, (Ni+Fe+Co), in atomic ratios satisfies $0.3 < Sn/(Ni+Fe+Co) < 5$, an average crystal grain diameter of $\alpha$ phase containing Cu, Zn, and Sn is in a range of 0.1 to 50 μm, and the copper alloy includes a precipitate containing P and one or more elements selected from Fe, Ni, and Co.

According to the fifth aspect of the present invention, SR resistance and strength can be improved further, by allowing the alloy to have a microstructure with an appropriate amount of precipitates, which are precipitated from the matrix (mainly $\alpha$ phase) and include P and one or more selected from Fe, Ni, and Co. The precipitates including P and one or more selected from Fe, Ni, and Co are referred as [Ni, Fe, Co]—P-based precipitates hereinafter. The above-described microstructure can be can be obtained by adding appropriate amounts of P and one or more selected from Ni, Fe, and Co simultaneously in addition to an appropriate amount of Sn, and controlling addition ratios among each of Sn, Ni, Fe, Co, and P appropriately.

Here, the [Ni, Fe, Co]—P-based precipitates denote quaternary system precipitates of Ni—Fe—Co—P, ternary system precipitates of Ni—Fe—P, Ni—Co—P, or Fe—Co—P, or binary system precipitates of Fe—P, Ni—P, or Co—P. Also, the [Ni, Fe, Co]—P-based precipitates denote multicomponent system precipitates containing, in addition to the above-mentioned elements, Cu, Zn, and Sn as an main component, and O, S, C, Cr, Mo, Mg, Mn, Zr, Ti or the like as impurities. Therefore, the above-mentioned [Ni—Fe]—P-based precipitates also belong to the [Ni, Fe, Co]—P-based precipitates. Also, the [Ni, Fe, Co]—P-based precipitates exist in the form of phosphide or alloy that dissolves phosphorus.

In the sixth to eighth aspects of the present invention, the microstructure such as precipitates of the alloy containing Co of the fifth aspect of the present invention is defined according to the above-mentioned second to fourth aspects of the present invention.

A copper alloy for EE device of the sixth aspect of the present invention is the copper alloy for EE device according to the above-described fifth aspect, wherein an average grain diameter of the precipitate containing P and one or more elements selected from Fe, Ni, and Co is 100 nm or less.

A copper alloy for EE device of the seventh aspect of the present invention is the copper alloy for EE device according to the above-described sixth aspect, wherein a precipitation density of the precipitate containing P and one or more elements selected from Fe, Ni, and Co, and having the average grain diameter of 100 nm or less is in a range of 0.001 to 1.0% in volume ratio.

A copper alloy for EE device according to the eighth aspect of the present invention is the copper alloy according to any one of the above-described fifth to seventh aspects, wherein the precipitate containing P and one or more elements selected from Fe, Ni, and Co has a crystal structure of $Fe_2P$-based crystal or $Ni_2P$-based crystal structure.

A copper alloy for EE device according to the ninth aspect of the present invention is the copper alloy according to any one of the above-described first to eighth aspects, wherein the copper alloy for electronic/electric device has a mechanical property such that 0.2% offset yield strength is 300 MPa or more.

The above-described copper alloy for EE device having a mechanical property such that 0.2% offset yield strength is 300 MPa or more is appropriately applicable to conductive components such as movable conductive piece of electromagnetic relay or a spring of terminal that require specifically high strength.

A tenth aspect of the present invention is a copper alloy thin plate for electronic/electric device, the copper alloy thin plate being made of a rolled material of the copper alloy according to any one of the above-described first to ninth aspects, wherein a thickness of the copper alloy thin plate is in a range of 0.05 to 1.0 mm.

In the copper alloy according to the above-described first to ninth aspects of the present invention and the copper alloy thin plate for EE device according to the tenth aspect of the present invention, a ratio of sampling points having a CI value of 0.1 or less may be 70% or less in the α phase, the CI value being acquired measuring an area of not smaller than 1000 $\mu m^2$ by EBSD method with 0.1 μm step intervals and analyzing the measurement data with an OIM data analysis software.

The copper alloy thin plate (strip) having the above-described thickness is appropriately applicable to connectors or other terminals, movable conductive piece of electromagnetic relays, lead frame or the like.

A copper alloy thin plate of an eleventh aspect of the present invention is the copper alloy thin plate for electronic/electric device according to the above-described tenth aspect, wherein a surface of the thin plate is plated with Sn.

In this case, the base substrate of the Sn plating is constituted of a Cu—Zn—Sn-based alloy containing 0.1 to 0.9% of Sn. Thus, a high recycling rate is ensured by collecting used components such as connectors as scraps of Sn-plate brass-based alloy.

In the twelfth to fourteenth aspects of the present invention, methods of producing a copper alloy for electronic/electric device are defined.

The twelfth aspect of the present invention is a method of producing a copper alloy for electronic/electric device, the method including the steps of: preparing a material of an alloy containing, in mass %, more than 2.0% and 36.5% or less of Zn, 0.1% or more and 0.9% or less of Sn, 0.05% or more and less than 1.0% of Ni, 0.001% or more and less than 0.10% of Fe, 0.005% or more and 0.10% or less of P, and the balance consisting of Cu and inevitable impurities, a content ratio of Fe to Ni, Fe/Ni, in an atomic ratio satisfying $0.002 \leq Fe/Ni < 1.5$, a content ratio of a sum of Ni and Fe, (Ni+Fe), to P, (Ni+Fe)/P, in an atomic ratio satisfying $3 < (Ni+Fe)/P < 15$, and a content ratio of Sn to a sum of Ni and Fe, (Ni+Fe), Sn/(Ni+Fe), in an atomic ratio satisfying $0.3 < Sn/(Ni+Fe) < 5$; performing a process to the material, the process including at least one plastic working and a heat treatment for recrystallization and precipitation to transform the material to a recrystallized plate with a recrystallization structure and a predetermined plate thickness; and performing finishing plastic working to the recrystallized plate with a working ratio of 1 to 70%, whereby a copper alloy, in which an average crystal grain diameter of an α phase containing Cu, Zn, and Sn is in a range of 0.1 to 50 μm, a ratio of sampling points having a CI value of 0.1 or less is 70% or less, and a precipitate containing P and one or more selected from Fe and Ni is included, is obtained, the CI value being acquired measuring an area of not smaller than 1000 $\mu m^2$ by EBSD method with 0.1 μm step intervals and analyzing the measurement data with an OIM data analysis software.

The thirteenth aspect of the present invention is a method of producing a copper alloy for electronic/electric device, the method including the steps of: preparing a material of an alloy containing, in mass %, more than 2.0% and 36.5% or less of Zn, 0.1% or more and 0.9% or less of Sn, 0.05% or more and less than 1.0% of Ni, 0.001% or more and less than 0.10% of Fe, 0.001% or more and less than 0.1% of Co, 0.005% or more and 0.10% or less of P, and the balance consisting of Cu and inevitable impurities, a content ratio of a sum of Fe and Co, (Fe+Co), to Ni, (Fe+Co)/Ni, in an atomic ratio satisfying $0.002 \leq (Fe+Co)/Ni < 1.5$, a content ratio of a sum of Ni, Fe, and Co, (Ni+Fe+Co), to P, (Ni+Fe+Co)/P, in an atomic ratio satisfying $3 < (Ni+Fe+Co)/P < 15$, and a content ratio of Sn to a sum of Ni, Fe, and Co, (Ni+Fe+Co), Sn/(Ni+Fe+Co), in an atomic ratio satisfying $0.3 < Sn/(Ni+Fe+Co) < 5$; performing a process to the material, the process including at least one plastic working and a heat treatment for recrystallization and precipitation to transform the material to a recrystallized plate with a recrystallization structure and a predetermined plate thickness; and performing finishing plastic working to the recrystallized plate with a working ratio of 1 to 70%, whereby a copper alloy, in which an average crystal grain diameter of an α phase containing Cu, Zn, and Sn is in a range of 0.1 to 50 μm, a ratio of sampling points having a CI value of 0.1 or less is 70% or less, and a precipitate containing P and one or more selected from Fe, Ni, and Co is included, is obtained, the CI value being acquired measuring an area of not smaller than 1000 $\mu m^2$ by EBSD method with 0.1 μm step intervals and analyzing the measurement data with an OIM data analysis software.

In the description above, EBSD method denotes the Electron Backscatter Diffraction Patterns method using a scanning electron microscope equipped with a backscattered electron diffraction imaging system. Also, OIM denotes a data analysis software, Orientation Imaging Microscopy, that is used for analysis of crystal orientation using data of EBSD measurement. CI value denotes a Confidential Index (CI) that is displayed as a value showing confidence of crystal orientation determination in the analysis using analysis software OIM Analysis (Ver 5.3) in the EBSD apparatus (for example, explained in more detail in "Textbook of EBSD: Introduction to the use of OIM, 3rd revised edition, Seiichi SUZUKI, September 9, TSL Solutions Ltd.").

When the microstructure on the sampling point measured by EBSD and analyzed by OIM is a deformation structure, the determined crystal orientation has a low confidence since the crystal patterns are unclear, resulting in a low CI value. Especially, when CI value is 0.1 or less, the microstructure on the sampling point can be regarded as a deformation structure. When the ratio of the sampling points, which have CI value of 0.1 or less is 70% or less and are regarded as the deformed structure, within the measurement area of 1000 $\mu m^2$ or more, it can be concluded that a recrystallization structure is maintained practically. In this case, deterioration of bendability due to the deformation structure can be prevented.

The fourteenth aspect of the present invention is a method of producing copper alloy for EE device according to the method of producing copper alloy of the above-described twelfth or thirteenth aspect, wherein the method further comprising the step of performing low temperature annealing at 50 to 800° C. for 0.1 second to 24 hours after the step of performing finishing plastic working.

By performing low temperature annealing at 50 to 800° C. for 0.1 second to 24 hours after the step of performing finishing plastic working, SR resistance can be improved. Thus, deformation of the material such as warping due to stress resided in the material can be prevented.

The fifteenth aspect of the present invention is a conductive component for electronic/electric device including a bended part made of the copper alloy for electronic/electric device according to any one of the above-described first to ninth aspects, wherein the bended part is pressed to a coupling conductive part by spring property of the bended part to secure an electric conductivity to the coupling conductive part.

The sixteenth aspect of the present invention is a terminal made of the copper alloy for electronic/electric device according to any one of the above-described first to ninth aspects.

The seventeenth aspect of the present invention is a conductive component for electronic/electric device including a bended part made of the copper alloy thin plate for electronic/electric device according to the above-described tenth or eleventh aspects, wherein the bended part is pressed to a coupling conductive part by spring property of the bended part to secure an electric conductivity to the coupling conductive part.

The eighteenth aspect of the present invention is a terminal made of the copper alloy thin plate for electronic/electric device according to the tenth and eleventh aspects of the present invention.

Effects of the Invention

According to the present invention, a copper alloy used for a conductive component of electronic/electric device, such as a connector, other terminals, a movable conductive piece of an electromagnetic relay, a lead frame, and the like, can be provided. stress relaxation resistance of the copper alloy is reliably and sufficiently excellent. Also, it allows to obtain a thinner component material than the conventional alloy. The copper alloy has a high strength, and other characteristics such as bendability, electric conductivity, and the like are excellent. In addition, by using the above-mentioned copper alloy, a copper alloy thin plate for EE device, a method of producing the copper alloy for EE device, a conductive component and a terminal for EE device can be provided.

DETAILED DESCRIPTION OF THE INVENTION

Figure 1:
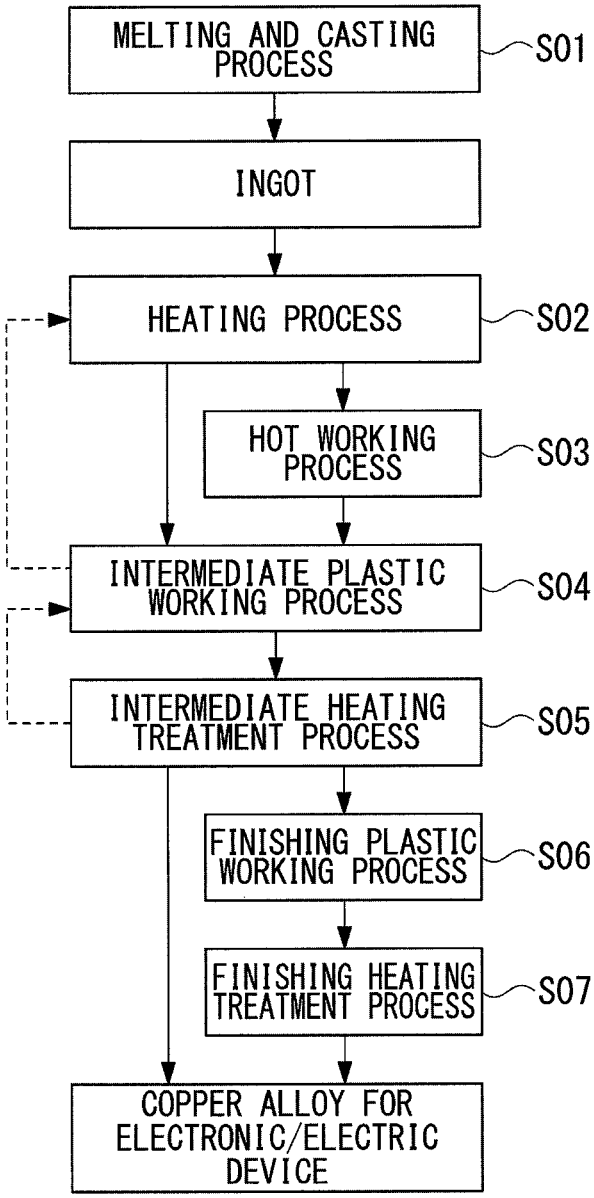
FIG. 1 is a flow chart that shows an example of steps of production process of copper alloy for EE device according to the present invention.

[Best Mode for Carrying Out the Invention]

The copper alloy for EE device according to the present invention will be explained in more detail below.

The basic embodiment of the copper alloy of the present invention is as follows. The copper alloy for electronic/electric device includes: more than 2% and 36.5% or less of Zn; 0.1% or more and 0.9% or less of Sn; 0.05% or more and less than 1.0% of Ni; 0.001% or more and less than 0.10% of Fe; 0.005% or more and 0.10% or less of P. Furthermore, as the content ratio among the above-described elements, the content ratio of Fe to Ni, Fe/Ni, in atomic ratio satisfies the formula (1) below.

$$0.002 \leq Fe/Ni < 1.5 \quad (1)$$

Furthermore, the content ratio of a sum of Ni and Fe, (Ni+Fe), to P, in atomic ratio satisfies the formula (2) below.

$$3 < (Ni+Fe)/P < 15 \quad (2)$$

Furthermore, the content ratio of Sn to a sum of Ni and Fe, (Ni+Fe), in atomic ratios satisfies the formula (3) below.

$$0.3 < Sn/(Ni+Fe) < 5 \quad (3)$$

The balance except for the above-mentioned element is consisted of Cu and inevitable impurities.

Furthermore, as the microstructure condition, the average crystal grain diameter of a phase containing Cu, Zn, and Sn is in a range of 0.1 to 50 μm, and the copper alloy includes a precipitate containing P and one or more elements selected from Fe and Ni. Hereinafter, the above-described precipitates are referred to as [Ni, Fe]—P-based precipitates.

Another embodiment of the copper alloy of the present invention is as follows. The copper alloy for electronic/electric device includes 0.001% or more and less than 0.10% of Co in addition to the above-mentioned Zn, Sn, Ni, Fe, and P. Furthermore, as the content ratio among the above-described elements, the content ratio of a sum of Fe and Co, (Fe+Co), to Ni, (Fe+Co)/Ni, in atomic ratio satisfies the formula (1') below.

$$0.002 \leq (Fe+Co)/Ni < 1.5 \quad (1')$$

Furthermore, the content ratio of a sum of Ni, Fe, and Co, (Ni+Fe+Co), to P, in atomic ratio satisfies the formula (2') below.

$$3 < (Ni+Fe+Co)/P < 15 \quad (2')$$

Furthermore, the content ratio of Sn to a sum of Ni, Fe, and Co, (Ni+Fe+Co), in atomic ratios satisfies the formula (3') below.

$$0.3 < Sn/(Ni+Fe+Co) < 5 \quad (3')$$

Furthermore, as the microstructure condition, the average crystal grain diameter of a phase containing Cu, Zn, and Sn is in a range of 0.1 to 50 μm, and the copper alloy includes a precipitate containing P and one or more elements selected from Fe, Ni, and Co. Hereinafter, the above-described precipitates are referred to as [Ni, Fe, Co]—P-based precipitates.

In addition to the basic embodiment and the other embodiment described-above, the embodiment explained below is also within the scope of the copper alloy for EE device of the present invention. The copper alloy for electronic/electric device includes: in mass %, more than 2% and 36.5% or less of Zn; 0.1% to 0.9% of Sn; 0.05% or more and less than 1.0% of Ni; 0.005% to 0.10% of P; 0.001% or more and less than 0.10% of Fe; less than 0.10% of Co; and the balance Cu and inevitable impurities. Furthermore, the content ratio of Fe to Ni, Fe/Ni, in atomic ratio satisfies $0.002 \leq Fe/Ni$, the content ratio of sum of Fe and Co, (Fe+Co), to Ni, (Fe+Co)/Ni, in atomic ratio satisfies $(Fe+Co)/Ni < 1.5$, the content ratio of a sum of Ni and Fe, (Ni+Fe), to P, in atomic ratio satisfies $3 < (Ni+Fe)/P$, the content ratio of a sum of Ni, Fe, and Co, (Ni+Fe+Co), to P, in atomic ratio satisfies $(Ni+Fe+Co)/P < 15$, the content ratio of Sn to a sum of Ni and Fe, (Ni+Fe), in atomic ratios satisfies $Sn/(Ni+Fe) < 5$, the content ratio of Sn to a sum of Ni, Fe, and Co, (Ni+Fe+Co), in atomic ratios satisfies 0.3<Sn/(Ni+Fe+Co). Furthermore, the average crystal grain diameter of α phase containing Cu, Zn, and Sn is in a range of 0.1 to 50 μm, and the copper alloy includes a precipitate containing P and one or more elements selected from Fe, Ni, and Co.

First, the reasons for limiting the element composition and the ratio among them in the copper alloy of the present invention are explained.

Zinc (Zn): more than 2.0% and 36.5% or less in mass %:

Zn is a fundamental alloying element in the copper alloy (brass) as a subject matter of the present invention. Zn is an element that is effective in improvement of strength and spring property. In addition, using Zn is effective on reducing material cost for the copper alloy since Zn is cheaper than Cu. If Zn content is 2.0% or less, the material cost cannot be reduced effectively. On the other hand, if Zn content exceeds 36.5%, anti-stress relaxation (anti-SR) characteristic of the copper alloy is reduced. Therefore, it becomes difficult to obtain sufficient SR resistance even if Fe, Ni, and P are added to the copper alloy in accordance with the present invention as explained below. Furthermore, corrosion resistance of the copper alloy is reduced, and cold rollability and bendability are deteriorated due to generation of β phase in a large amount. Therefore, the amount of Zn is set to be in the range of more than 2.0% and 36.5% or less. Within the above-described range, a preferable amount of Zn is 4.0 to 36.5%. More preferably, it is in the range of 8.0 to 32.0%. Even more preferably, it is in the range of 8.0 to 27.0%.

Tin (Sn): 0.1% or more and 0.9% or less in mass %

Addition of Sn is effective in improvement of strength. Addition of Sn to the raw material brass alloy as a material of EE device contributes to improvement of recycling performance of the brass material plated with Sn. Further, it was found that coexistence of Sn with Ni and Fe contributes to improvement of SR resistance of copper alloy based on the research conducted by the inventors of the present invention and other. When Sn content is less than 0.1%, the above-described effects cannot be obtained sufficiently. When Sn content exceeds 0.9%, hot workability and cold rollability of the copper alloy is deteriorated, thereby causing a possibility of occurrence of cracking during the hot rolling or cold rolling, and resulting in reduction of conductivity. Therefore, the amount of Sn is set in the range of 0.1% or more and 0.9% or less.

Within the above-described range, a preferable Sn content is preferably in the range of 0.2% or more and 0.8% or less.

Nickel (Ni): 0.05% or more and less than 1.0% in mass

Ni is a characteristic additional element in the present invention as well as Fe and P. It is possible to cause precipitation of [Ni, Fe]—P-based precipitates from the matrix (mainly composed of α phase) by the coexistence of Ni with Fe and P by adding appropriate amount of Ni to the Cu—Zn—Sn-based alloy. In addition, it is possible to cause precipitation of [Ni, Fe, Co]—P-based precipitates from the matrix (mainly composed of α phase) by the coexistence of Ni with Fe, Co, and P. By the presence of these [Ni, Fe]—P-based precipitates or [Ni, Fe, Co]—P-based precipitates, it is possible to reduce the average crystal grain diameter of the matrix and thereby enhancing the strength of the copper alloy by the effect of pinning the grain boundaries during the recrystallization process. In addition, it is also possible to improve bendability and stress corrosion cracking resistance by thus reducing average crystal diameter of the matrix. Further, SR resistance is improved significantly by the presence of these precipitates. In addition, by making Ni coexists with Sn, Fe, Co, and P, it is possible to improve the properties of the copper alloy not only by the improvement of anti SR characteristic by the precipitates but also by the solution strengthening. When the amount of Ni is less than 0.05%, SR resistance cannot be improved sufficiently. On the other hand, when the amount of added Ni is 1.0% or more, excessive Ni is dissolved in the copper alloy resulting in deterioration of conductivity, and increase of cost due to the increased amount of expensive Ni in the raw material. Therefore, the amount of Ni addition is defined in the range of 0.05% or more and less than 1.0%. Within the above-described range, the preferable amount of Ni addition is in the range of 0.05% or more and less than 0.8%.

Iron (Fe): 0.001% or more and less than 0.10% in mass %

Fe is a characteristic additional element in the present invention as well as Ni and P. It is possible to cause precipitation of [Ni, Fe]—P-based precipitates from the matrix (mainly composed of α phase) by the coexistence of Fe with Ni and P by adding appropriate amount of Fe to the Cu—Zn—Sn-based alloy. In addition, it is possible to cause precipitation of [Ni, Fe, Co]—P-based precipitates from the matrix (mainly composed of α phase) by the coexistence of Fe with Ni, Co, and P. By the presence of these [Ni, Fe]—P-based precipitates or [Ni, Fe, Co]—P-based precipitates, it is possible to reduce the average crystal grain diameter of the matrix and thereby enhancing the strength of the copper alloy by the effect of pinning the grain boundaries during the recrystallization process. In addition, it is also possible to improve bendability and stress corrosion cracking resistance by thus reducing the average crystal grain diameter. Further, SR resistance is improved significantly by the presence of these precipitates. When the amount of Fe is less than 0.001%, sufficient strength cannot be obtained due to insufficient effect of pinning the crystal grain boundaries. On the other hand, when the amount of added Fe is 0.10% or more, strength of the copper alloy is not further improved, and excessive Fe is dissolved in the copper alloy resulting in deterioration of conductivity and deterioration of cold workability. Therefore, the amount of Fe addition is defined in the range of 0.001% or more and less than 0.10%. Within the above-described range, the preferable amount of Fe addition is in the range of 0.005% or more and 0.08% or less.

Cobalt (Co): 0.001% or more and less than 0.10% in mass %

Although Co is not an essential additional element, addition of small amount of Co with Ni, Fe, and P causes generation of [Ni, Fe, Co]—P-based precipitates resulting in further improvement of SR resistance. When the amount of Co addition is less than 0.001%, further improvement of SR resistance by the effect of Co addition cannot be obtained. On the other hand, when the amount of added Co is 0.10% or more, excessive Co is dissolved in the copper alloy resulting in deterioration of conductivity, and increase of cost due to the increased amount of expensive Co in the raw material. Therefore, the amount of Co in the case of adding Co is defined in the range of 0.005% or more and less than 0.10%. In the above-described range, the amount of Ni addition is preferably controlled in the range of 0.005% or more and 0.08% or less. Even if the Co is not added intentionally, less than 0.001% of Co may be added as an impurity.

Phosphorus (P): 0.005% or more and 0.10% or less

P has a strong bondability to Fe, Ni, and Co. It is possible to cause precipitation of [Ni, Fe]—P-based precipitates by making the copper alloy contain appropriate amount of P with Fe and Ni. In addition, it is possible to cause precipitation of [Ni, Fe, Co]—P-based precipitates by making the copper alloy contain appropriate amount of P with Fe, Ni, and Co. By the presence of these precipitates, it is possible to improve SR resistance of the copper alloy. When the amount of P is less than 0.005%, it is difficult to form [Ni, Fe]—P-based precipitates or [Ni, Fe, Co]—P-based precipitates sufficiently, resulting in insufficient improvement of SR resistance of the copper alloy. On the other hand, when the amount of P exceeds 0.10%, excessive P is dissolved in the alloy, resulting in reduction of conductivity and deterioration of rollability, thereby causing tendency to occur cracking in cold rolling process. Therefore, the amount of P was defined to be in the range of 0.005% or more and 0.10% or less. Within the above-described range, the preferable amount of P is in the range of 0.01% or more and 0.08% or less.

P is an element that is often contaminated inevitably from the raw material of copper melt. Therefore, it is desirable to select the raw material of the melt appropriately so as to control the amount of P to be in the above described range.

In general, the balance for the above-described elements may be controlled to be Cu and inevitable impurities. Examples of the inevitable impurities include Mg, Al, Mn, Si, (Co), Cr, Ag, Ca, Sr, Ba, Sc, Y, Hf, V, Nb, Ta, Mo, W, Re, Ru, Os, Se, Te, Rh, Ir, Pd, Pt, Au, Cd, Ga, In, Li, Ge, As, Sb, Ti, Ti, Pb, Bi, S, O, C, Be, N, H, Hg, B, Zr, rare earth element and the like. Preferably, total amount of the inevitable impurities is 0.3% by mass or less.

In the copper alloy for EE device according to the present invention, it is important not only to control individual range of the amount of each alloying elements to be in the above-described range, but also to define the relative ratio of the contents of each elements such that the above described formulae (1) to (3) or the above-described formulae (1') to (3') are satisfied. The following are reasons for setting the formulae (1) to (3) and (1') to (3').

$$0.002 \leq Fe/Ni < 1.5 \quad \text{Formula (1)}$$

According to the careful experiments by the inventors, it was found that Fe/Ni ratio had a large influence on SR resistance and that SR resistance could be improved sufficiently only when Fe/Ni ratio is in a specific range. That is, the inventors found that sufficient improvement of SR resistance could be obtained when the relative ratio of Fe to Ni was controlled to be in the range of 0.002 or more and less than 1.5 while making Fe and Ni coexist and controlling the individual contents of Fe and Ni in the above-described range. SR resistance of the alloy is deteriorated when Fe/Ni ratio is 1.5 or more, and the strength of the alloy is deteriorated when the Fe/Ni ratio is less than 0.002. In addition, when Fe/Ni ratio is less than 0.002, expensive Ni raw material is used in relatively large amount, resulting in increase of production cost. Therefore, Fe/Ni ratio was defined in the above-described range. Within the above-described range, a preferable Fe/Ni ratio is in the range of 0.005 or more and 1 or less. An even more preferable Fe/Ni ratio is in the range of 0.005 or more and 0.5 or less.

$$3 < (Ni+Fe)/P < 15 \quad \text{Formula (2)}$$

[Ni, Fe]—P-based precipitates are generated by the coexistence of Ni and Fe with P, and SR resistance of the alloy is improved by the dispersed distribution of the [Ni, Fe]—P-based precipitates. On the other hand, when excessive P is contained relative to (Ni+P), SR resistance is deteriorated due to increase of the fractions of Ni and Fe dissolved in the alloy. Therefore, it is important to control the (Ni+Fe)/P ratio in order to improve SR resistance sufficiently. When (Ni+Fe)/P ratio is less than 3, SR resistance of copper alloy is deteriorated in accordance with increased fraction of solid-solubilized P. In addition, cracking tends to occur in cold rolling process due to deterioration of rollability, and bendability is also reduced. On the other hand, when (Ni+Fe)/P ratio is 15 or more, conductivity of the copper alloy is reduced due to increase of the fraction of solid-solubilized Ni and Fe. Therefore, (Ni+Fe)/P ratio was defined to be in the above-described range. Within the above-described range, a preferable (Ni+Fe)/P ratio is in the range of more than 3 and 12 or less.

$$0.3 < Sn/(Ni+Fe) < 5 \quad \text{Formula (3)}$$

As described above, Sn contributes to improvement of SR resistance when Sn coexists with Ni and Fe. The effect of improvement of SR resistance is not exerted unless the Sn/(Ni+Fe) ratio is in the specific range. When Sn/(Ni+Fe) ratio is 0.3 or less, sufficient SR resistance is not exerted. On the other hand, when Sn/(Ni+Fe) ratio is 5 or more, the amount of the [Ni, Fe]—P-based precipitates is reduced due to relatively small (Ni+Fe) content, resulting in deterioration of SR resistance. Within the above-described range, a preferable Sn/(Ni+Fe) ratio is in the range of more than 0.3 and 2.5 or less. An even more preferable Sn/(Ni+Fe) ratio is in the range of more than 0.3 and 1.5 or less.

$$0.002 \leq (Fe+Co)/Ni < 1.5 \quad \text{Formula (1')}$$

When Co is added in the alloy, it is interpreted that a partial amount of Fe is replaced by Co. Therefore, Formula (1') is basically in accordance with Formula (1). When Co is added to the copper alloy in addition to Fe and Ni, SR resistance is significantly affected by (Fe+Co)/Ni ratio. Only when (Fe+Co)/Ni ratio is within a specific range, sufficient improvement of SR resistance can be obtained. Thus, the inventor of the present invention found that not only allowing to co-exist Ni, Fe, and Co and controlling content amounts of Fe, Ni, and Co as described above, but setting the content ratio of a sum of Fe and Co, (Fe+Co), to Ni, (Fe+Co)/Ni, in atomic ratio within the range of 0.002 or more and less than 1.5 is essential for obtaining sufficient improvement of SR resistance. SR resistance of the alloy is deteriorated when Fe/Ni ratio is 1.5 or more, and strength of the alloy is deteriorated when Fe/Ni ratio is less than 0.002. In addition, when Fe/Ni ratio is less than 0.002, expensive Ni raw material is used in a relatively large amount, resulting in increase of production cost. Therefore, Fe/Ni ratio was defined in the above-described range. Within the above-described range, a preferable Ni/Fe ratio is in the range of 0.005 or more and 1 or less. A more preferable Ni/Fe ratio is in the range of 0.005 or more and 0.5 or less.

$$3 < (Ni+Fe+Co)/P < 15 \quad \text{Formula (2')}$$

When Co is added in the alloy, Formula (2') is basically in accordance with Formula (2). Thus, [Ni, Fe, Co]—P-based precipitates are generated by the coexistence of Ni, Fe, and Co with P and SR resistance of alloy is improved by the dispersed distribution of [Ni, Fe, Co]—P-based precipitates. On the other hand, when excessive P is contained relative to (Ni+Fe+Co), SR resistance is deteriorated due to increase of ratio of the solid-solubilized P. Therefore, it is important to control the (Ni+Fe+Co)/P ratio in order to improve SR resistance sufficiently. When (Ni+Fe+Co)/P ratio is less than 3, SR resistance of copper alloy is deteriorated in accordance with increased fraction of solid-solubilized P. In addition, cracking tends to occur in cold rolling process due to deterioration of rollability, and bendability is also reduced. On the other hand, when (Ni+Fe+Co)/P ratio is 15 or more, conductivity of the copper alloy is reduced due to increase of the fraction of solid-solubilized Ni, Fe, and Co. Therefore, (Ni+Fe+Co)/P ratio was defined to be in the above-described range. Within the above-described range, a preferable (Ni+Fe+Co)/P ratio is in the range of more than 3 and 12 or less.

$$0.3 < Sn/(Ni+Fe+Co) < 5 \quad \text{Formula (3')}$$

When Co is added in the alloy, Formula (3') is basically in accordance with Formula (3). Thus, Sn contributes to improvement of SR resistance when Sn coexists with Ni, Fe, and Co. The effect of improvement of SR resistance is not exerted unless Sn/(Ni+Fe+Co) ratio is in the specific range. When Sn/(Ni+Fe+Co) ratio is 0.3 or less, sufficient SR resistance is not exerted. On the other hand, when Sn/(Ni+Fe+Co) ratio is 5 or more, the amount of the [Ni, Fe, Co]—P-based precipitates is reduced due to relatively small (Ni+Fe+Co) content, resulting in deterioration of SR resistance. Within the above-described range, a preferable Sn/(Ni+Fe+Co) ratio is in the range of more than 0.3 and 2.5 or less. An even more preferable Sn/(Ni+Fe+Co) ratio is in the range of more than 0.3 and 1.5 or less.

When each individual content amount of each alloy element is set as described, and the content ratios among the elements are set to satisfy the formulae (1) to (3) or the formulae (1') to (3') in the copper alloy for EE device, [Ni, Fe]—P-based precipitates or [Ni, Fe, Co]—P-based precipitates are dispersed and precipitated in the matrix (mainly α phase). It is believed that SR resistance is improved by having the precipitates dispersed and precipitated.

In addition to adjusting the composition as described above, it is important to define the average crystal grain diameter of the matrix in a range of 0.1 to 50 μm in the copper alloy for EE device of the present invention. It is known that the crystal grain diameter effects on SR resistance in a certain extent. In general, the shorter the crystal grain diameter, the lower SR resistance. On the other hand, strength and bendability are improved when the crystal grain diameter becomes shorter. In the alloy of the present invention, an excellent SR resistance can be secured by adjusting element composition and the ratios among the elements appropriately. Therefore, strength and bendability can be improved by shortening the crystal grain diameter. Here, strength and bendability can be improved while keeping the SR resistance, if the average crystal grain diameter is in the range of 0.1 μm or more to 50 μm or less in the process after the finishing heat treatment for recrystallization and precipitation during the production process. When the average crystal grain diameter exceeds 50 μm, sufficient strength and bendability cannot be obtained. When the average crystal grain diameter is less than 0.1 μm, it becomes difficult to secure the SR resistance even if the element composition and the content ratios among the elements are adjusted appropriately. A preferable average crystal grain diameter to improve balance among SR resistance, strength, and bendability, is in the range of 0.5 to 20 μm. More preferably, it is in the range of 0.5 to 5 μm. Here, the average diameter of crystal grain means the average grain diameter of the crystals in the matrix of the alloy, which is a subject matter of the present invention. The matrix is the α phase including Cu as the majority and solid-dispersing Zn and Sn.

Furthermore, it is important that there are [Ni, Fe]—P-based precipitates or [Ni, Fe, Co]—P-based precipitates in the copper alloy for EE device of the present invention. Based on research by the inventors of the present invention, it has been found that these precipitates form a hexagonal crystal (space group: P-62m (189)), which is the $Fe_2P$-based or $Ni_2P$-based crystal structure, or a rhombic crystal (space group: P-rma (62)), which is the $Fe_2P$-based crystal structure. In addition, it is preferable that the average diameter of these precipitates is 100 nm or less, making them to be fine precipitates. By the presence of the fine precipitates, strength and bendability of the copper alloy can be improved due to miniaturization of the crystals while retaining the excellent SR resistance. When the average diameter of the precipitates exceeds 100 nm, its contribution to improvement of strength and SR resistance is reduced.

Further, it is preferable that the ratio of the fine precipitates having the average grain diameter of 100 nm or less in the copper alloy for EE device of the present invention is 0.001% or more and 1% or less in volume ratio. When the volume ratio of the fine precipitates having the average grain diameter of 100 nm or less is less than 0.001%, it becomes difficult to secure the excellent SR resistance in the copper alloy. Also, it becomes difficult to obtain the improved strength and bendability sufficiently. On the other hand, when the volume ratio exceeds 1%, bendability of the copper alloy is deteriorated. A preferable ratio of the fine precipitates having the average grain diameter of 100 nm or less is in the range of 0.005% to 0.5%. More preferably, it is in the range of 0.01% to 0.2%.

Further, it is preferable that in the crystal grains of the α phase containing Cu, Zn, and Sn, a ratio of sampling points having a CI value of 0.1 or less is 70% or less when the CI value is acquired by measuring an area of not smaller than 1000 $\mu m^2$ by EBSD method with 0.1 μm step intervals and analyzing the measurement data with an OIM data analysis software. The reason for that is described below.

As a treatment for improving the proof stress as a copper alloy product, it is preferable to perform the finishing plastic working as the final process as explained later in the explanation of the production method. This is a treatment for improving the proof stress as the copper alloy product, and the working method is not particularly limited. However, if the final form of the product is in a plate-shape or a stripshape, the rolling process is applied normally. Then, if the finishing plastic working is performed by the rolling process, the crystal grains are deformed to extend in the direction parallel to the rolling direction.

CI (Confidence Index) value obtained by analysis with analysis software OIM installed on an EBSD apparatus, CI value becomes low when the crystal pattern on the sampling point is not clear. When CI value is 0.1 or less, the microstructure is regarded as a deformation structure. Further, when the ratio of sampling points having a CI value of 0.1 or less is 70% or less, the recrystallized microstructure is practically retained, and bendability is not deteriorated.

Here, when the finishing plastic working is performed by the rolling process, the measurement surface for EBSD method is the perpendicular surface relative to the rolling width direction (vertical section), which is TD (Transvers Direction) surface. When the finishing plastic working is performed by a process other than the rolling process, a vertical section along with the major working direction is utilized as the measurement surface in accordance with TD surface in the case of the rolling process.

When working is performed in such a way that the ratio of sampling points having a CI value of 0.1 or less more than 70%, the stress introduced during the working process becomes too strong and bendability could be deteriorated.

Parts made of the copper alloy of the present invention, such as the copper alloy thin plate for EE device of the present invention, have the characteristics defined by the above-described CI value in terms of the crystal grains of the matrix (α phase).

Next, a preferable example of the method of producing the above-described copper alloy for EE device of the present embodiment is explained in reference to the flowchart shown in FIG. 1.

[Melting and Casting Process: S01]

First, a copper alloy melt having composition as described above is smelted. It is preferable to use 4NCu with a purity of 99.99% or more, for example the oxygen-free copper, as the copper material in the melting raw material. However, scrap can be used as a raw material instead.

Next, the copper alloy melt having adjusted composition is casted by an appropriate casting method, such as the batch-type casting method using a mold, the continuous casting method, the semi-continuous casting method, and the like, to obtain an ingot (slab-shaped ingot or the like).

[Heating Process: S02]

Then, if it is needed, the homogenization treatment for homogenizing the microstructure of the ingot by resolving the segregation in the ingot is performed as the heating process S2 to the ingot. The condition for the homogenization treatment is not particularly limited. In general, it is sufficient to heat the ingot at 600 to 950° C. for 5 minutes to 24 hours. When the temperature for the homogenization treatment is less than 600° C., or the time for the homogenization treatment is less than 5 minutes, it is possible that a sufficient homogenizing effect cannot obtained. When the temperature exceeds 950° C., or the time is longer than 24 hours, it simply increase the production cost. The cooling condition after the homogenization treatment can be set appropriately. In general, performing the water quenching is sufficient. If needed, face milling is performed.

[Hot Working: S03]

Next, a hot working may be performed to the ingot after the above-described heating process S02 for making the crude processing more efficient and homogenization of microstructure. The condition for the hot working process is not particularly limited. In general, a preferable condition is that: the start temperature is 600 to 950° C., the end temperature is 300 to 850° C., and the processing rate is roughly 10 to 99%. Heating of the ingot until the beginning of the hot working can be overlapped with the above-described heating process S02. In other words, the hot working process may be initiated in the state where the temperature is lowered to the temperature for staring the hot working process after the homogenization treatment without cooling the ingot to near the room temperature. The cooling condition after the hot working process can be appropriately set. In general, performing the water quenching is sufficient. After the how working process, if needed, face milling is performed. The method for hot working is not particularly limited. In a case where the final shape of the product is in a plate or a strip, the ingot is rolled to the plate thickness of 0.5 to 50 mm by applying hot rolling. When the final shape of the product is in a line-shape or a rod-shape, extrusion or groove rolling can be applied. When the shape of the final product is in a bulk shape, casting or pressing can be applied.

[Intermediate Plastic Working: S04]

The intermediate plastic working is performed on the ingot subjected to the homogenization treatment in the heating process S02 as described above, or the material that is subjected to the hot working (S03) such as hot rolling further if it is needed. The temperature condition for the intermediate plastic working S04 is not particularly limited. However, it is preferable that the temperature is between −200° C. to +200° C., meaning the treatment is cold working or hot working. The processing rate of the intermediate plastic working is also not particularly limited. However, it is set to 10 to 99% generally. The method for working is not particularly limited. However, when the shape of the final product is in a plate-shape or the strip-shape, the working can be performed by cold rolling or hot rolling until the thickness becomes about 0.02 to 25 mm by applying rolling. When the shape of the final product is in a line-shape or a rod-shape, extrusion or groove rolling can be applied. When the shape of the final product is in a bulk shape, casting or pressing can be applied. The processes S02 to S04 can be repeated in order to have thoroughly solubilized material.

[Intermediate Heating Treatment Process: S05]

The intermediate heating treatment process is performed after the intermediate plastic working (S04) which is cold working or warm working, such as cold rolling. In the intermediate heating treatment process, the recrystallization treatment and the precipitation treatment are performed at the same time. This intermediate heating treatment process is a critical process for recrystallization of the copper alloy composition and precipitating the dispersed [Ni, Fe]—P-based precipitates or the dispersed [Ni, Fe, Co]—P-based precipitates. Thus, the heating temperature and the heating time conditions allowing formation of these precipitates can be applied. In general, the temperature condition for the intermediate heating treatment process is 200 to 800° C. and the time condition is 1 second to 24 hours. However, since the crystal grain diameter also effects on SR resistance in a certain extent as explained above, it is preferable to select appropriate heating temperature and heating time by measuring the crystal grain diameter after the intermediate heating treatment process. The intermediate heating treatment process and cooling after the process effect on the average crystal grain diameter of the final product. Thus, it is preferable that the conditions for the above-mentioned process and cooling are selected appropriately in such a way that the average crystal diameter in the α phase is in the range of 0.1 to 50 μm.

As explained below, preferable heating temperature and time for the intermediate heating treatment process differ depending on specific heat treatment methods.

In terms of the specific methods for the intermediate heating treatment process, a batch-type heating furnace can be used. Instead, the material can be heated continuously with a continuous annealing line. A preferable condition for the intermediate heating treatment process is that heating temperature is 300 to 800° C. and the heating time is 5 minutes to 24 hours when the batch-type heating furnace is used. A preferable condition for the intermediate process is that the heating temperature reached is in the range of 250 to 800° C. when the continuous annealing line. The material does not have to be kept in the range at all, or is kept in the range for about 1 second to 5 minutes. It is preferable that the atmosphere for the intermediate heating treatment process is non-oxidizing atmosphere (nitrogen gas atmosphere, inner gas atmosphere, or reducing atmosphere).

The cooling condition for the intermediate heating treatment process is not particularly limited. in general, the cooling can be done in the cooling rate of about 2000° C./sec to 100° C./hour.

If it is needed, the above-explained intermediate plastic working process S04 and the intermediate heating treatment process S05 can be repeated multiple times. Thus, for example, the first intermediate heating treatment can be performed after the first cold rolling as the first intermediate plastic working, and then the second intermediate heating treatment is performed after the second cold rolling as the second intermediate plastic working.

[Finishing Plastic Working: S06]

The copper alloy finishing work to the final dimension and shape is performed after the intermediate heating treatment process 505. The working method for the finishing plastic working is not particularly limited. However, when the shape of the final product of the copper alloy is in a plate-shape or a strip-shape, rolling (cold rolling) is applied in general. In such a case, the copper alloy is rolled to the thickness of about 0.05 to 1.0 mm. Instead, depending on the shape of the final product, casting, pressing, groove rolling, or the like can be applied. The pressing rate can be set depending on the final thickness or the shape of the final product. However, a preferable working rate is 1 to 70%. When the working rate is less than 1%, the proof stress cannot be improved sufficiently. When it is more than 70%, the recrystallized microstructure is lost practically and turned into the deformation structure, leading to reduced bendability. A more preferable working rate is 1 to 65%. An even more preferable working rate is to 60%. When the finishing plastic working is performed by rolling, the rolling rate corresponds to the working rate. After the finishing plastic working process, the processed alloy can be used directly like as a connector. However, it is preferably subjected to the finishing heating treatment thither in general.

[Finishing Heat Treatment Process: S07]

After the finishing plastic working, depending on necessity, the finishing heat treatment process S07 is performed for improvement of SR resistance, low temperature annealing curing, or eliminating residual stress. It is preferable that the finishing heat treatment process is performed at 50 to 800° C. for 0.1 second to 24 hours. It is possible that the residual stress cannot be eliminated sufficiently if the finishing heat treatment process is performed at less than 50° C., or for shorter than 0.1 second. On the other hand, the production cost would be increased if the finishing heat treatment process is performed for longer than 24 hours. When the finishing plastic working S06 is not performed, then the finishing heat treatment process S07 may be omitted.

As explained above, Cu—Zn—Sn-based alloy material in the final product shape can be obtained. In the alloy material, the dispersed [Ni, Fe]—P-based precipitates or the dispersed [Ni, Fe, Co]—P-based precipitates are precipitated from the master phase which is mainly the α phase. Particularly, when rolling is applied as the working method, the thin plate (a strip material) of Cu—Zn—Sn-based alloy with the thickness of about 0.05 to 1.0 mm is obtained. Such a thin plate can be used for a conductive component for EE device as it is. However, Sn plating with the thickness of about 0.1 to 10 μm is formed on one side or both sides of the plate. Then, it is used as a copper alloy strip with Sn plating for a conductive component of EE device, such as a connector, other terminal, or the like. In such a case, the method for Sn plating is not particularly limited. However, the electrolytic plating can be applied in accordance with the conventional method. Instead, the reflow treatment can be performed after the electrolytic plating in some cases.

As described above, bending is performed to the thin plate frequently when the copper alloy for EE device of the present invention is used for producing a connector or other terminal in fact. Also, the bended part is pressed to the coupling conductive part by its spring property to secure an electric conductivity to the coupling conductive part near the part subjected to the bending in general. The copper alloy of the present invention is suitable for usage in the embodiment described above.

The results of the tests conducted to confirm the effect of the present invention are shown as Examples of the present invention and Comparative Examples. These Examples are for explaining the effect of the present invention, and not for limiting the scope of the present invention by configurations, processes, and conditions described in the explanations of Examples of the present invention.

EXAMPLES

First, the melting and casting process S01 was performed as follows. Materials made of the Cu-40% Zn mother alloy and the oxygen free copper (ASTM B152 C10100) with a purity of 99.99 mass % or more were prepared. Then, these materials were inserted in the high purity graphite crucible. Then, they were melted with an electric furnace in a $N_2$ gas atmosphere. Then, each additional element was added in the copper alloy melts. In this way, the alloy melts having compositions No. 1 to No. 58 shown in Tables 1 to 3 as Example of the present invention and ones having compositions No. 101 to 118 shown in Table 4 as Comparative Example were smelted. Then, the smelted melts were poured in carbon molds to obtain ingots. The dimension of the ingot is roughly 25 mm×50 mm×200 mm (thickness×width×length).

Next, water quenching was performed to each ingot in Ar gas atmosphere as the homogenization treatment (heating process S02).

Next, hot rolling was performed as the hot working S03. Specifically, the ingots ware re-heated for the starting temperature of the hot rolling to be 800° C. Then, hot rolling, in which the rolling rate is about 50%, was performed setting the width direction of the ingot to be the rolling direction. Then, water quenching was performed at the rolling ending temperature between 300 to 700° C. Then, the hot rolling materials having dimension of about 11 mm×160 mm×100 mm (thickness×width×length) were produced after performing cutting and surface grinding of the hot rolled and water quenched materials.

Then, the intermediate plastic working S04 and the intermediate heat treatment process S05 were performed once, or repeated twice. Specifically, in No. 1, Nos. 5-42, No. 45, No. 47, No. 48, and Nos. 101-118 in Tables 5 to 8, the second intermediate heating treatment was performed after performing the first cold rolling as the first inter mediate plastic working. Then, the second intermediate plastic working was performed after performing the second cold rolling as the second intermediate plastic working. On the other hand, in Nos. 2-4, No. 43, No. 44, No. 46, Nos. 49-58, and No. 101, the first intermediate heat treatment was performed after performing the first cool rolling as the first intermediate plastic working. After that, the second intermediate plastic working (the second cool rolling) or the second intermediate heat treatment was not performed.

More specifically, in Nos. 2-4, No. 43, No. 44, No. 46, Nos. 49-58, and No. 101, a heat treatment was performed at 200 to 800° C. for a certain period of time as the first intermediate heat treatment for recrystallization and precipitation treatment after performing the first cool rolling (the first intermediate plastic working) in which the rolling rate is about 90% or more. Then, water quenching was performed. Then, the rolled materials were cut and subjected to surface grinding to remove the oxidized coating after the first intermediate heat treatment and the water quenching. Then, they were applied to the finishing plastic working that is explained lately.

On the other hand, in No. 1, Nos. 5-42, No. 45, No. 47, No. 48, and Nos. 102-118, a heat treatment was performed at 200 to 800° C. for a certain period of time as the first intermediate heat treatment after performing the first cool rolling (the first intermediate plastic working) in which the rolling rate was about 50 to 95%. Then, they were water quenched. Then, the second cool rolling (the second intermediate plastic working) in which the rolling rate was about 50 to 95% was performed. Then, further, the second intermediate heat treatment was performed at 200 to 800° C. for a certain period of time in such a way that the average crystal grain diameter after the heat treatment became about 10 μM or less. Then, they were water quenched. Then, the rolled materials were cut and subjected to surface grinding for removing the oxidized coating after performing the second intermediate heat treatment and the water quenching. Then, they were applied to the finishing plastic working that is explained lately.

In the step after the first or the second intermediate heat treatment, the average crystal grain diameter was measured as explained below.

When the average crystal grain diameter exceeded 10 μm, the surface perpendicular to the normal line of the rolled surface of each sample, which is ND (Normal Direction) surface, was set to the observation surface. The photographic image of NO surface was taken in a direction where the rolling direction corresponds to the horizontal direction of the image with an optical microscope after mirror polishing and etching. Then, observation was performed within a field of view of 1,000-fold (about 300×200 $\mu m^2$). Then, the average crystal grain diameter was calculated in accordance with the cutting method defined by JIS H 0501. In the method, two sets of five lines with a predetermined length were drawn in the photographic image, one set in the vertical direction and another set in the horizontal direction. Then, the number of crystal grains completely cut though was counted. Then, the average of the crystal grain diameter is obtained as the average value of the cut length.

When the average crystal grain diameter is 10 μm or less, the surface perpendicular to the width direction of the rolling, which is TD surface, was set to the observation surface. Then, the average crystal grain diameter was measured with SEM-EBSD (Electron Backscatter Diffraction Patterns) measuring apparatus. Specifically, the finishing polishing was performed with colloidal silica solution after performing mechanical polishing with a waterproof abrasive paper or abrasive diamond grains. Then, electron beam was irradiated on each measuring point (pixel) within the measuring area on the surface of the sample with a scanning electron microscope. Then, a boundary having 15° or more of angle difference between the neighboring measuring points was assigned as the large angle grain boundary, and a boundary having 15° or less of angle difference between the neighboring measuring points was assigned the small angle grain boundary based on the orientation analysis by the backscattered electron diffraction. Then, the grain boundary map was made using the large angle grain boundary. Then, the average crystal grain diameter was calculated in accordance with the cutting method defined by JIS H 0501. In the method, two sets of five lines with a predetermined length were drawn in the grain boundary map, one set in the vertical direction and another set in the horizontal direction. Then, the number of crystal grains completely cut though was counted. Then, the average of the crystal grain diameter is obtained as the average value of the cut length.

The average crystal grain diameters measured as explained above in the step after the first intermediate heat treatment or the second intermediate heat treatment are shown in Tables 5 to 8.

Then, the finishing rolling was performed as the finishing plastic working S06. The rolling rates for the finishing rolling are shown in Tables 5 to 8.

Finally, the testing strips having dimension of 0.25 mm×about 160 mm (thickness×width) were produced by water quenching and performing cutting and surface polishing after performing the heat treatment at 200 to 350° C. as the finishing heat treatment S07.

Conductivity and mechanical characteristic (proof stress) of these testing strips were measured. Also, SR resistance was investigated. Also, microstructure was observed. The testing and measurement methods for each characteristic are as explained below. The results of the testing and measurement are shown in Tables 9 to 12.

[Mechanical Characteristic]

A 13B testing piece that was defined by JIS Z 2201 was obtained from the testing strip. Then, 0.2% proof stress $\sigma_{0.2}$ was measured by the offset method of JIS Z 2241. The testing piece was obtained in such way that the pulling direction in the pulling test was set to be perpendicular to the rolling direction of the testing strip.

[Conductivity]

A testing piece with a dimension of 10 mm×60 mm (width×length) was obtained from the testing strip. Then, electric resistance was measure by the four-terminal method. Also, volume of the testing piece was measured by measuring dimension of the testing piece with a micrometer. Then, conductivity was calculated from the measure electric resistance and volume. The testing piece was obtained in such a way that the longitudinal direction of the testing piece is in parallel to the rolling direction of the testing strip.

[Stress Relaxation Resistance]

In the SR resistance test, stress was applied based on the method in accordance with the cantilever screw-type. Then, the residual stress rate after a certain period of retention at 120° C. was measured.

In the method, a test piece (width: 10 mm) was obtained from each testing strip in the direction perpendicular to the rolling direction. Then, the initial set was set to 2 mm, and the spun length was adjusted in order for the maximum surface stress of the testing piece to be 80% of the proof stress. The above-mentioned maximum surface stress can be obtained from the formula shown below.

$$\text{Maximum surface stress (MPa)}=1.5Et\delta_0/L_s^2$$

wherein,

E: deflection factor (MPa)

T: thickness of the sample (t=0.25 mm)

$\delta_0$: initial deflection set (2 mm)

$L_s$: spun length (mm).

The residual stress rate was measured based on the curved shape after retention for 1,000 hours at 120° C., and the SR resistance was evaluated. The residual stress rate was calculated using the formula shown below.

$$\text{Residual stress rate (\%)}=(1-\delta_t/\delta_0)\times 100$$

Wherein, $\delta_t$: permanent set after retention for 1,000 hours at 120° C. (mm) minus permanent set after retention for 24 hours at normal temperature (mm)

$\lambda_0$: initial set (mm).

In terms of the evaluation of SR resistance, when the sample contained more than 2% and less than 20% of Zn (samples labeled in the column labeled as "2-20Zn Evaluation" in Tables 9 to 12), a sample having the above-mentioned residual stress rate of 80% or more was evaluated as "A" (Excellent). Similarly, a sample having the residual stress rate of 70% or more and less than 80% was evaluated as "B" (Acceptable). A sample having the residual stress rate of less than 70% was evaluated as "C" (Not acceptable). When the sample contained more than 20% and less than 36.5% of Zn (samples labeled in the column labeled as "20-30Zn Evaluation" in Tables 9 to 12), a sample having the above-mentioned residual stress rate of 70% or more was evaluated as "A" (Excellent). Similarly, a sample having the residual stress rate of 60% or more and less than 70% was evaluated as "B" (Acceptable). A sample having the residual stress rate of less than 60% was evaluated as "C" (Not acceptable).

[Crystal Grain Observation]

The surface perpendicular to the width direction of rolling, which is TD (Transverse direction) surface, was set to the observation surface. Then, the crystal grain boundary and the crystal grain orientation distribution were measured as explained below using EBSD measuring apparatus and OIM analysis software.

The finishing polishing was performed using colloidal silica solution after performing mechanical polishing with a waterproof abrasive paper or abrasive diamond grains. Then, the analysis of crystal grain orientation difference was performed using EBSD measuring apparatus (Quanta FEG 450 manufacture by FEI Inc., OIM Data Collection manufactured by EDAX/TSL Inc. (currently AMETEK Inc.)) and the analysis software (OIM Data Analysis ver. 5.3 developed by EDAX/XTL Inc. (currently AMETEK Inc.)) in the condition where the electron beam acceleration voltage was 20 kV, the interval of the sampling points was 0.1 μm step, and the measurement area was 1,000 $\mu m^2$ or more. CI value for each sampling point was calculated by the analysis software OIM, and the crystal grains having CI value of 0.1 or less were excluded from the analysis of the crystal grain diameter. In terms of the grain boundary, the boundary having 15° or more of angle difference between the neighboring two crystals was assigned as the large angle grain boundary, and the boundary having 15° or less of angle difference between the neighboring two crystals was assigned the small angle grain boundary based on observation of the two dimensional cross section. Using the large angle grain boundary, the crystal grain map was made. Then, the average crystal grain diameter was calculated in accordance with the cutting method defined by JIS H 0501. In the method, two sets of five lines with a predetermined length were drawn in the grain boundary map, one set in the vertical direction and another set in the horizontal direction. Then, the number of crystal grains completely cut though was counted. Then, the average of the crystal grain diameter was obtained as the average value of the cut length.

In the description of the present invention, the average crystal grain diameter defines about the crystal grains in α phase. In the above-described average crystal grain diameter measurement, crystals in phases other than α phase, such as β phase, were not existed. However, when such grains were existed, they were excluded in the calculation of the average crystal grain diameter.

[Precipitate Observation]

Precipitate observation was performed on each testing strip using a transmission-type electron microscope (TEM: H-800, HF-2000, and HF-2200 manufactured by Hitachi, Ltd., JEM-2010F manufactured by JEOL Ltd.) and EDX analysis apparatus (EDX analysis apparatus Vantage manufactured by Noran Inc.) as described below.

Figure 2:
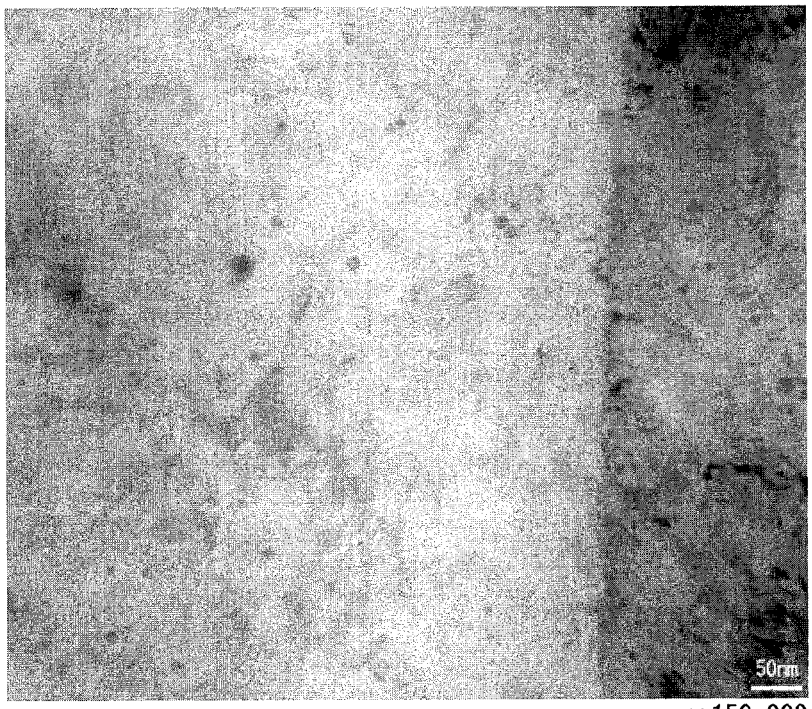
FIG. 2 is a photograph of microstructure of an alloy of Example No. 5 according to the embodiment of the present invention. The microstructure image is obtained by a transmission electron microscope (TEM). The portion including the precipitates is magnified 150,000-fold
Figure 3:
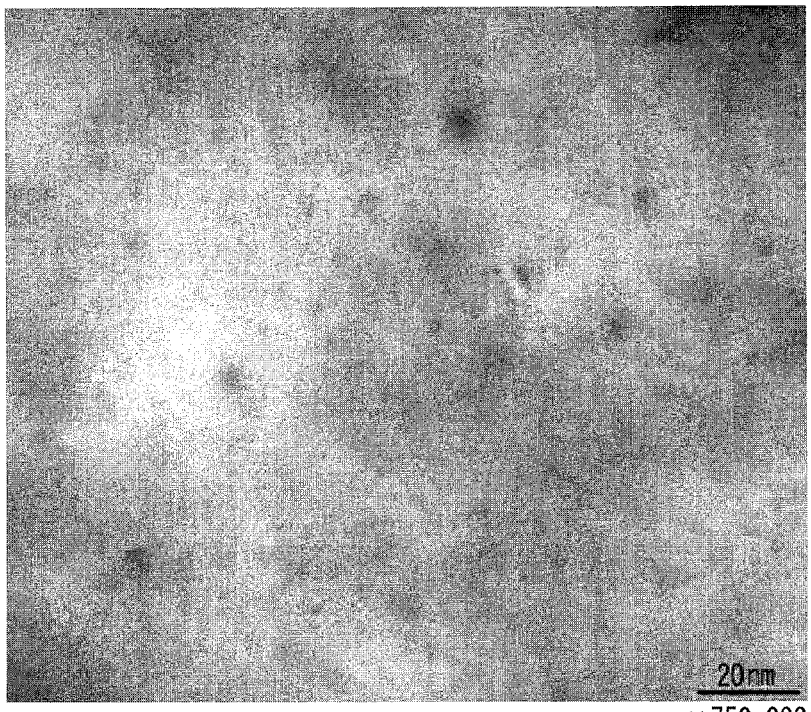
FIG. 3 is a photograph of microstructure of an alloy of Example No. 5 according to the embodiment of the present invention. The microstructure image is obtained by a transmission electron microscope (TEM). The portion including the precipitates is magnified 750,000-fold

On Example No. 5 of the present invention, precipitates having grain diameters of 10 to 100 nm were observed in the magnification of 150,000-fold (observation field area is about $4\times10^5$ $nm^2$) by using TEM (FIG. 2). Also, precipitates having grain diameter of 1 to 10 nm were observed in the magnification of 750,000-fold (observation field area is about $2\times10^4$ $nm^2$) (FIG. 3).

Figure 4:
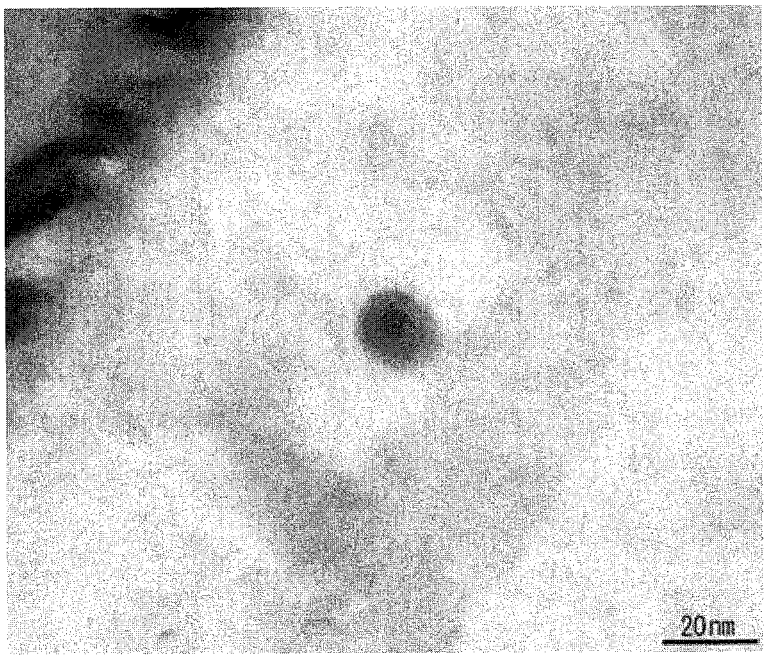
FIG. 4 is a photograph of microstructure of an alloy of Example No. 5 according to the embodiment of the present invention. The microstructure image is obtained by a transmission electron microscope (TEM). The portion including the precipitates is magnified 500,000-fold

Further, it was confirmed that the precipitates were hexagonal crystals having $Fe_2P$-based or $Ni_2P$-based crystal structure or rhombic crystals having the $Fe_2P$-based crystal structure by electric beam diffraction of the precipitates having grain diameter of about 20 nm. Here, the precipitate that was subjected to the electron beam diffraction corresponds to the dark oval-shaped part in the middle in FIG. 4.

Figure 5:
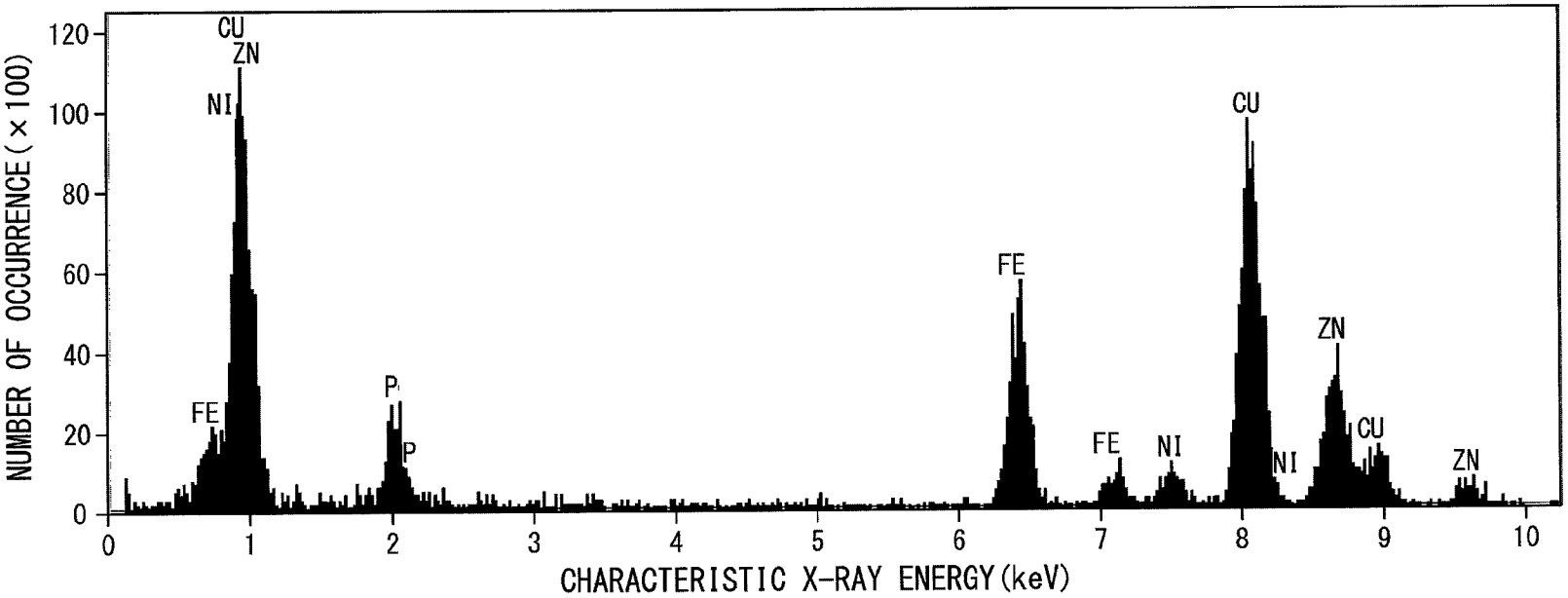
FIG. 5 is a graph that shows a result of EDX (Energy Dispersive X-ray spectroscopy) analysis of the precipitate shown in FIG. 4.

The result analyzing the composition of the precipitate using EDX (Energy Dispersive X-ray Spectroscopy) was shown in FIG. 5. Based on the result shown in FIG. 5, it was confirmed that the precipitate included Ni, Fe, and P, and belonged to [Ni, Fe]—P based precipitated as defined above.

[Volume Fraction of the Precipitates]

The volume fraction of the precipitates was calculated as explained below.

First, the equivalent circle diameter corresponding to the precipitate, which had grain diameter of 10 to 100 nm mainly in the 150,000-fold observation field shown in FIG. 2, was obtained by image processing. Then, the equivalent circle diameter corresponding to the precipitate, which had grain diameter of 1 to 10 nm mainly in the 750,000-fold observation field shown in FIG. 3, was obtained by image processing. Then, the size and volume of each precipitate were calculated based on the obtained diameters. Then, the total volume fraction of the precipitates having grain diameter of 1 to 100 nm was obtained by combining both volume fractions. Also, the thickness of the sample coating was measured by using the contamination method. In this contamination method, contamination was adhered on a part of the sample. Then, the thickness of the sample t was determined from the formula below by using increase of the length of the contamination when the sample was tilted 0°.

$$t=\Delta L/\sin\theta$$

The thickness t obtained by the formula was multiplied by the observation field area to obtain the volume of the observed field. Then, the volume fraction was determined from the rate of the volume of the observed field to the total volume of the precipitates.

In terms of Example No. 5 of the present invention, the volume fraction of the precipitates having grain diameter of 10 to 100 nm (volume fraction of precipitates obtained in the observation in the magnification of 150,000-fold) was 0.07% as shown in Table 13. Also, the volume fraction of the precipitates having grain diameter of 1 to 10 nm (volume fraction of precipitates obtained in the observation in the magnification of 750,000-fold) was 0.05%. Therefore, the volume fraction the precipitates having grain diameter of 1 to 100 nm, including Fe, Ni, and P, and having $Fe_2P$-based or $Ni_2P$-based crystal structure, was 0.12% total. Thus, it was in the range of the preferable volume fraction of the present invention.

In the other Example of the present invention, No. 4, No. 13, No. 17, and No. 18, the volume fractions of the precipitates were measured, they were within the preferable range of the volume fraction of the present invention as shown in Table 13.

[CI Value]

The final polishing was performed to the surface perpendicular to the width direction of rolling of the testing strip, which was TD (Transverse direction) surface, after performing mechanical polishing with a waterproof abrasive paper or abrasive diamond grains. Then, the analysis of crystal grain orientation difference was performed using EBSD measuring apparatus (Quanta FEG 450 manufacture by FET Inc., OIM Data Collection manufactured by EDAX/TSL Inc. (currently AMETEK Inc.)) and the analysis software (OIM Data Analysis ver. 5.3 developed by EDAX/XTL Inc. (currently AMETEK Inc.)) in the condition where the electron beam acceleration voltage was 20 kV, the interval of the sampling points was 0.1 μm step, and the measurement area was 1,000 $\mu m^2$ or more. Then, the ratio of the sampling points having CI value of 0.1 or less relative to the all sampling points was calculated. For the measurement of the ratio, the ratio was measured in 10 different observation fields that were selected as the observation field without any aberrant microstructure, and expressed as the average value of them.

This CI value measurement was performed as a part of above-mentioned crystal grain diameter observation.

Results of the above-described observations of microstructures and results of each evaluation are shown in TABLES 9 to 12.

TABLE 1

[Example of the Present Invention]

| No. | Alloy Composition (unit: mass %) Zn | Sn | Ni | Fe | P | Co | Cu | Element Ratio in Alloy (Fe + Co)/Ni atomic ratio | (Ni + Fe + Co)/P atomic ratio | Sn/(Ni + Fe + Co) atomic ratio |
|---|---|---|---|---|---|---|---|---|---|---|
| 1 | 32.5 | 0.52 | 0.11 | 0.054 | 0.017 | — | Balance | 0.52 | 5.2 | 1.5 |
| 2 | 29.6 | 0.50 | 0.09 | 0.044 | 0.018 | — | Balance | 0.51 | 4.0 | 1.8 |
| 3 | 29.6 | 0.50 | 0.09 | 0.044 | 0.018 | — | Balance | 0.51 | 4.0 | 1.8 |
| 4 | 29.6 | 0.50 | 0.09 | 0.044 | 0.018 | — | Balance | 0.51 | 4.0 | 1.8 |
| 5 | 29.6 | 0.50 | 0.09 | 0.044 | 0.018 | — | Balance | 0.51 | 4.0 | 1.8 |
| 6 | 30.2 | 0.48 | 0.12 | 0.050 | 0.018 | — | Balance | 0.44 | 5.1 | 1.4 |
| 7 | 29.1 | 0.45 | 0.10 | 0.049 | 0.019 | — | Balance | 0.51 | 4.2 | 1.5 |
| 8 | 29.1 | 0.45 | 0.10 | 0.049 | 0.019 | — | Balance | 0.51 | 4.2 | 1.5 |
| 9 | 29.1 | 0.45 | 0.10 | 0.049 | 0.019 | — | Balance | 0.51 | 4.2 | 1.5 |
| 10 | 30.9 | 0.21 | 0.12 | 0.064 | 0.024 | — | Balance | 0.56 | 4.1 | 0.6 |
| 11 | 30.0 | 0.72 | 0.12 | 0.045 | 0.029 | — | Balance | 0.39 | 3.0 | 2.1 |
| 12 | 29.6 | 0.79 | 0.74 | 0.043 | 0.079 | — | Balance | 0.06 | 5.2 | 0.5 |
| 13 | 30.1 | 0.53 | 0.43 | 0.044 | 0.027 | — | Balance | 0.11 | 9.3 | 0.6 |
| 14 | 30.8 | 0.46 | 0.21 | 0.053 | 0.031 | — | Balance | 0.27 | 4.5 | 0.9 |
| 15 | 29.4 | 0.51 | 0.09 | 0.019 | 0.019 | — | Balance | 0.22 | 3.1 | 2.3 |
| 16 | 29.8 | 0.50 | 0.15 | 0.089 | 0.035 | — | Balance | 0.62 | 3.7 | 1.0 |
| 17 | 30.1 | 0.46 | 0.10 | 0.021 | 0.018 | 0.021 | Balance | 0.43 | 4.2 | 1.6 |
| 18 | 25.5 | 0.44 | 0.09 | 0.051 | 0.019 | — | Balance | 0.60 | 4.0 | 1.5 |
| 19 | 20.9 | 0.45 | 0.10 | 0.046 | 0.020 | — | Balance | 0.48 | 3.9 | 1.5 |

TABLE 2

[Example of the Present Invention]

| No. | Alloy Composition (unit: mass %) Zn | Sn | Ni | Fe | P | Co | Cu | Element Ratio in Alloy (Fe + Co)/Ni atomic ratio | (Ni + Fe + Co)/P atomic ratio | Sn/(Ni + Fe + Co) atomic ratio |
|---|---|---|---|---|---|---|---|---|---|---|
| 20 | 15.1 | 0.47 | 0.12 | 0.049 | 0.019 | — | Balance | 0.43 | 4.8 | 1.4 |
| 21 | 15.2 | 0.19 | 0.11 | 0.054 | 0.024 | — | Balance | 0.52 | 3.7 | 0.6 |
| 22 | 14.9 | 0.73 | 0.12 | 0.047 | 0.029 | — | Balance | 0.41 | 3.1 | 2.1 |
| 23 | 14.8 | 0.79 | 0.71 | 0.049 | 0.080 | — | Balance | 0.07 | 5.0 | 0.5 |
| 24 | 15.1 | 0.49 | 0.43 | 0.051 | 0.028 | — | Balance | 0.12 | 9.1 | 0.5 |
| 25 | 14.3 | 0.47 | 0.21 | 0.042 | 0.033 | — | Balance | 0.21 | 4.1 | 0.9 |
| 26 | 15.0 | 0.43 | 0.11 | 0.020 | 0.021 | — | Balance | 0.19 | 3.3 | 1.6 |
| 27 | 14.8 | 0.43 | 0.15 | 0.080 | 0.035 | — | Balance | 0.56 | 3.5 | 0.9 |
| 28 | 15.1 | 0.41 | 0.13 | 0.021 | 0.018 | 0.032 | Balance | 0.41 | 5.4 | 1.1 |
| 29 | 9.8 | 0.51 | 0.13 | 0.050 | 0.019 | — | Balance | 0.40 | 5.1 | 1.4 |
| 30 | 5.3 | 0.51 | 0.15 | 0.051 | 0.018 | — | Balance | 0.36 | 6.0 | 1.2 |
| 31 | 5.3 | 0.20 | 0.11 | 0.054 | 0.024 | — | Balance | 0.52 | 3.7 | 0.6 |
| 32 | 5.0 | 0.73 | 0.12 | 0.047 | 0.029 | — | Balance | 0.41 | 3.1 | 2.1 |
| 33 | 5.4 | 0.79 | 0.72 | 0.049 | 0.089 | — | Balance | 0.07 | 4.6 | 0.5 |
| 34 | 5.0 | 0.49 | 0.41 | 0.051 | 0.028 | — | Balance | 0.13 | 8.7 | 0.5 |
| 35 | 4.6 | 0.42 | 0.23 | 0.042 | 0.033 | — | Balance | 0.19 | 4.4 | 0.8 |
| 36 | 4.7 | 0.50 | 0.11 | 0.020 | 0.021 | — | Balance | 0.19 | 3.3 | 1.9 |
| 37 | 4.6 | 0.46 | 0.19 | 0.080 | 0.035 | — | Balance | 0.44 | 4.1 | 0.8 |
| 38 | 5.5 | 0.43 | 0.14 | 0.021 | 0.018 | 0.032 | Balance | 0.39 | 5.7 | 1.1 |
| 39 | 2.9 | 0.51 | 0.15 | 0.051 | 0.018 | — | Balance | 0.36 | 6.0 | 1.2 |

TABLE 3

[Example of the Present Invention]

| No. | Alloy Composition (unit: mass %) Zn | Sn | Ni | Fe | P | Co | Cu | Element Ratio in Alloy (Fe + Co)/Ni atomic ratio | (Ni + Fe + Co)/P atomic ratio | Sn/(Ni + Fe + Co) atomic ratio |
|---|---|---|---|---|---|---|---|---|---|---|
| 40 | 30.1 | 0.60 | 0.66 | 0.041 | 0.066 | — | Balance | 0.07 | 5.6 | 0.42 |
| 41 | 22.1 | 0.71 | 0.69 | 0.012 | 0.061 | — | Balance | 0.02 | 6.1 | 0.50 |
| 42 | 14.6 | 0.42 | 0.59 | 0.008 | 0.054 | — | Balance | 0.014 | 5.8 | 0.35 |
| 43 | 7.8 | 0.61 | 0.50 | 0.018 | 0.041 | — | Balance | 0.04 | 6.7 | 0.58 |
| 44 | 8.4 | 0.51 | 0.63 | 0.004 | 0.059 | — | Balance | 0.007 | 5.7 | 0.40 |
| 45 | 9.2 | 0.74 | 0.91 | 0.045 | 0.045 | — | Balance | 0.052 | 11.2 | 0.38 |
| 46 | 3.4 | 0.60 | 0.64 | 0.009 | 0.054 | — | Balance | 0.01 | 6.3 | 0.46 |
| 47 | 21.5 | 0.66 | 0.61 | 0.005 | 0.048 | 0.023 | Balance | 0.05 | 7.0 | 0.51 |
| 48 | 13.3 | 0.55 | 0.54 | 0.003 | 0.053 | 0.034 | Balance | 0.07 | 5.7 | 0.47 |
| 49 | 7.8 | 0.61 | 0.50 | 0.004 | 0.041 | 0.021 | Balance | 0.05 | 6.8 | 0.57 |
| 50 | 3.4 | 0.57 | 0.67 | 0.002 | 0.052 | 0.018 | Balance | 0.03 | 7.0 | 0.41 |
| 51 | 6.6 | 0.54 | 0.54 | 0.002 | 0.049 | — | Balance | 0.004 | 5.8 | 0.49 |
| 52 | 4.8 | 0.89 | 0.49 | 0.001 | 0.054 | — | Balance | 0.002 | 4.8 | 0.90 |
| 53 | 6.5 | 0.61 | 0.58 | 0.001 | 0.049 | 0.001 | Balance | 0.004 | 6.3 | 0.52 |
| 54 | 6.8 | 0.56 | 0.56 | 0.002 | 0.052 | 0.002 | Balance | 0.007 | 5.7 | 0.49 |
| 55 | 11.4 | 0.56 | 0.53 | 0.002 | 0.052 | — | Balance | 0.004 | 5.4 | 0.52 |
| 56 | 10.5 | 0.57 | 0.50 | 0.001 | 0.048 | — | Balance | 0.002 | 5.5 | 0.56 |
| 57 | 8.4 | 0.62 | 0.60 | 0.001 | 0.048 | 0.001 | Balance | 0.003 | 6.6 | 0.51 |
| 58 | 9.2 | 0.60 | 0.55 | 0.002 | 0.054 | 0.002 | Balance | 0.007 | 5.4 | 0.54 |

TABLE 4

[Comparative Example]

| No. | Alloy Composition (unit: mass %) Zn | Sn | Ni | Fe | P | Co | Cu | Element Ratio in Alloy (Fe + Co)/Ni atomic ratio | (Ni + Fe + Co)/P atomic ratio | Sn/(Ni + Fe + Co) atomic ratio |
|---|---|---|---|---|---|---|---|---|---|---|
| 101 | 30.3 | 0.46 | 0.11 | 0.049 | 0.012 | — | Balance | 0.5 | 7.1 | 1.4 |
| 102 | 29.5 | — | — | — | — | — | Balance | — | — | — |
| 103 | 28.6 | 0.54 | — | 0.049 | 0.023 | — | Balance | — | 1.2 | 5.2 |
| 104 | 29.4 | 0.48 | 0.06 | 0.098 | 0.018 | — | Balance | 1.7 | 4.8 | 1.5 |
| 105 | 29.3 | 0.64 | 0.15 | — | 0.019 | — | Balance | — | 4.2 | 2.1 |
| 106 | 15.1 | — | — | — | — | — | Balance | — | — | — |
| 107 | 15.1 | 0.51 | — | — | — | — | Balance | — | — | — |
| 108 | 14.7 | 0.48 | — | — | 0.024 | — | Balance | — | — | — |
| 109 | 15.4 | 0.52 | — | 0.046 | 0.025 | — | Balance | — | 1.0 | 5.3 |
| 110 | 15.0 | 0.50 | 0.05 | 0.095 | 0.025 | — | Balance | 2.0 | 3.2 | 1.6 |
| 111 | 14.3 | 0.55 | 0.14 | — | 0.023 | — | Balance | — | 3.2 | 1.9 |
| 112 | 5.1 | — | — | — | — | — | Balance | — | — | — |
| 113 | 4.8 | 0.46 | — | — | — | — | Balance | — | — | — |
| 114 | 5.3 | 0.54 | — | — | 0.023 | — | Balance | — | — | — |
| 115 | 5.2 | 0.49 | — | 0.047 | 0.020 | — | Balance | — | 1.3 | 4.9 |
| 116 | 5.5 | 0.52 | 0.02 | 0.091 | 0.023 | — | Balance | 4.8 | 2.7 | 2.2 |
| 117 | 4.7 | 0.53 | 0.13 | — | 0.018 | — | Balance | — | 3.8 | 2.0 |
| 118 | 2.8 | — | — | — | — | — | Balance | — | — | — |

TABLE 5

[Example of the Present Invention]

| No. | Process: Homogenization temperature (° C.) | Hot rolling starting temperature (° C.) | Average crystal grain diameter after 1st intermediate heating treatment (μm) | Average crystal grain diameter after 2nd intermediate heating treatment (μm) | Finishing plastic working rolling rate (%) | Finishing heating treatment temperature (° C.) |
|---|---|---|---|---|---|---|
| 1 | 800 | 800 | — | 1.2 | 22 | 300 |
| 2 | 800 | 800 | 35 | — | 20 | 300 |
| 3 | 800 | 800 | 16 | — | 25 | 300 |
| 4 | 800 | 800 | 1.1 | — | 16 | 300 |
| 5 | 800 | 800 | — | 0.9 | 15 | 300 |
| 6 | 800 | 800 | — | 5.2 | 21 | 300 |
| 7 | 800 | 800 | — | 0.8 | 24 | 350 |
| 8 | 800 | 800 | — | 0.8 | 32 | 350 |
| 9 | 800 | 800 | — | 0.8 | 56 | 350 |
| 10 | 800 | 800 | — | 1.0 | 21 | 350 |
| 11 | 800 | 800 | — | 1.1 | 21 | 350 |
| 12 | 800 | 800 | — | 1.1 | 20 | 350 |
| 13 | 800 | 800 | — | 1.2 | 20 | 350 |
| 14 | 800 | 800 | — | 0.9 | 20 | 350 |
| 15 | 800 | 800 | — | 1.1 | 17 | 350 |
| 16 | 800 | 800 | — | 1.0 | 21 | 350 |
| 17 | 800 | 800 | — | 1.2 | 17 | 350 |
| 18 | 800 | 800 | — | 1.2 | 20 | 300 |
| 19 | 800 | 800 | — | 1.1 | 21 | 300 |

TABLE 6

[Example of the Present Invention]

| No. | Process: Homogenization temperature (° C.) | Hot rolling starting temperature (° C.) | Average crystal grain diameter after 1st intermediate heating treatment (μm) | Average crystal grain diameter after 2nd intermediate heating treatment (μm) | Finishing plastic working rolling rate (%) | Finishing heating treatment temperature (° C.) |
|---|---|---|---|---|---|---|
| 20 | 800 | 800 | — | 1.2 | 25 | 250 |
| 21 | 800 | 800 | — | 1.2 | 26 | 250 |
| 22 | 800 | 800 | — | 1.4 | 24 | 250 |
| 23 | 800 | 800 | — | 1.2 | 25 | 250 |
| 24 | 800 | 800 | — | 1.3 | 25 | 250 |
| 25 | 800 | 800 | — | 1.4 | 26 | 250 |
| 26 | 800 | 800 | — | 1.2 | 27 | 250 |
| 27 | 800 | 800 | — | 1.4 | 26 | 250 |
| 28 | 800 | 800 | — | 1.3 | 24 | 250 |
| 29 | 800 | 800 | — | 1.8 | 27 | 250 |
| 30 | 800 | 800 | — | 2.6 | 33 | 250 |
| 31 | 800 | 800 | — | 3.3 | 34 | 250 |
| 32 | 800 | 800 | — | 2.4 | 35 | 250 |
| 33 | 800 | 800 | — | 2.6 | 35 | 250 |
| 34 | 800 | 800 | — | 3.2 | 34 | 250 |
| 35 | 800 | 800 | — | 2.4 | 35 | 250 |
| 36 | 800 | 800 | — | 3.4 | 34 | 250 |
| 37 | 800 | 800 | — | 2.4 | 36 | 250 |
| 38 | 800 | 800 | — | 2.8 | 33 | 250 |
| 39 | 800 | 800 | — | 2.7 | 36 | 200 |

TABLE 7

[Example of the Present Invention]

| No. | Process: Homogenization temperature (° C.) | Hot rolling starting temperature (° C.) | Average crystal grain diameter after 1st intermediate heating treatment (μm) | Average crystal grain diameter after 2nd intermediate heating treatment (μm) | Finishing plastic working rolling rate (%) | Finishing heating treatment temperature (° C.) |
|---|---|---|---|---|---|---|
| 40 | 800 | 800 | — | 1.6 | 55 | 300 |
| 41 | 800 | 800 | — | 2.9 | 60 | 300 |
| 42 | 800 | 800 | — | 2.5 | 56 | 300 |
| 43 | 800 | 800 | 2.9 | — | 47 | 300 |
| 44 | 800 | 800 | 4.3 | — | 44 | 300 |
| 45 | 800 | 800 | — | 2.20 | 51 | 300 |
| 46 | 800 | 800 | 4.7 | — | 43 | 300 |
| 47 | 800 | 800 | — | 2.6 | 57 | 300 |
| 48 | 800 | 800 | — | 2.9 | 58 | 300 |
| 49 | 800 | 800 | 2.5 | — | 52 | 300 |
| 50 | 800 | 800 | 2.5 | — | 58 | 300 |
| 51 | 800 | 800 | 3.1 | — | 52 | 350 |
| 52 | 800 | 800 | 3.7 | — | 45 | 350 |
| 53 | 800 | 800 | 4.8 | — | 51 | 350 |
| 54 | 800 | 800 | 5.0 | — | 51 | 350 |
| 55 | 800 | 800 | 3.9 | — | 50 | 350 |
| 56 | 800 | 800 | 3.8 | — | 43 | 350 |
| 57 | 800 | 800 | 4.5 | — | 50 | 350 |
| 58 | 800 | 800 | 5.2 | — | 48 | 350 |

TABLE 8

[Comparative Example]

| No. | Process: Homogenization temperature (° C.) | Hot rolling starting temperature (° C.) | Average crystal grain diameter after 1st intermediate heating treatment (μm) | Average crystal grain diameter after 2nd intermediate heating treatment (μm) | Finishing plastic working rolling rate (%) | Finishing heating treatment temperature (° C.) |
|---|---|---|---|---|---|---|
| 101 | 800 | 800 | 120 | — | 13 | 300 |
| 102 | 800 | 800 | — | 3.6 | 25 | 250 |
| 103 | 800 | 800 | — | 1.3 | 20 | 300 |
| 104 | 800 | 800 | — | 1.1 | 16 | 300 |
| 105 | 800 | 800 | — | 21 | 20 | 300 |
| 106 | 800 | 800 | — | 4 | 29 | 250 |
| 107 | 800 | 800 | — | 5.0 | 27 | 250 |
| 108 | 800 | 800 | — | 4.4 | 29 | 250 |
| 109 | 800 | 800 | — | 1.3 | 26 | 250 |
| 110 | 800 | 800 | — | 1.1 | 27 | 250 |
| 111 | 800 | 800 | — | 14 | 25 | 300 |
| 112 | 800 | 800 | — | 5.6 | 37 | 250 |
| 113 | 800 | 800 | — | 5.9 | 34 | 250 |
| 114 | 800 | 800 | — | 5.2 | 35 | 250 |
| 115 | 800 | 800 | — | 2.7 | 34 | 250 |
| 116 | 800 | 800 | — | 2.9 | 35 | 250 |
| 117 | 800 | 800 | — | 16 | 36 | 300 |
| 118 | 800 | 800 | — | 8.1 | 39 | 200 |

TABLE 9

[Example of the Present Invention]

| | Microstructure | | Evaluation | | | |
|---|---|---|---|---|---|---|
| | CI value | Average | Electric | | Anti-SR characteristic | |
| No. | (ratio of CI value of 0.1) (%) | crystal grain diameter (μm) | conductivity (% IACS) | Proof stress (MPa) | 2-20Zn evaluation | 20-30Zn evaluation |
| 1 | 21.6 | 0.9 | 23% | 643 | — | B |
| 2 | 23.1 | 33 | 24% | 493 | — | A |
| 3 | 23.9 | 14 | 24% | 520 | — | A |
| 4 | 18.2 | 1.0 | 23% | 578 | — | B |
| 5 | 17.0 | 0.8 | 24% | 580 | — | B |
| 6 | 22.4 | 4.1 | 24% | 594 | — | A |
| 7 | 20.8 | 0.6 | 24% | 664 | — | B |
| 8 | 31.3 | 0.6 | 24% | 710 | — | B |
| 9 | 67.0 | 0.4 | 23% | 791 | — | B |
| 10 | 22.8 | 0.8 | 25% | 621 | — | B |
| 11 | 21.5 | 0.9 | 22% | 644 | — | B |
| 12 | 18.4 | 0.8 | 20% | 668 | — | A |
| 13 | 23.0 | 1.0 | 23% | 624 | — | A |
| 14 | 22.2 | 0.7 | 23% | 619 | — | A |
| 15 | 20.4 | 0.9 | 24% | 593 | — | A |
| 16 | 22.7 | 0.8 | 24% | 636 | — | B |
| 17 | 19.0 | 1.0 | 24% | 587 | — | B |
| 18 | 21.8 | 1.0 | 25% | 602 | — | A |
| 19 | 22.5 | 0.9 | 28% | 578 | — | A |

TABLE 10

[Example of the Present Invention]

| | Microstructure | | Evaluation | | | |
|---|---|---|---|---|---|---|
| | CI value | Average | Electric | | Anti-SR characteristic | |
| No. | (ratio of CI value of 0.1) (%) | crystal grain diameter (μm) | conductivity (% IACS) | Proof stress (MPa) | 2-20Zn evaluation | 20-30Zn evaluation |
| 20 | 27.5 | 0.9 | 30% | 576 | B | — |
| 21 | 28.1 | 0.9 | 32% | 551 | B | — |
| 22 | 21.5 | 1.0 | 28% | 602 | B | — |
| 23 | 25.4 | 0.9 | 28% | 610 | A | — |
| 24 | 25.9 | 1.0 | 31% | 583 | A | — |
| 25 | 25.1 | 1.0 | 32% | 575 | A | — |
| 26 | 25.0 | 0.9 | 31% | 569 | A | — |
| 27 | 25.2 | 1.1 | 29% | 601 | B | — |
| 28 | 24.4 | 1.0 | 31% | 574 | B | — |
| 29 | 26.3 | 1.3 | 37% | 506 | A | — |
| 30 | 34.9 | 1.8 | 41% | 481 | B | — |
| 31 | 33.5 | 2.3 | 43% | 470 | B | — |
| 32 | 21.5 | 1.6 | 44% | 493 | B | — |
| 33 | 33.9 | 1.7 | 43% | 511 | A | — |
| 34 | 33.0 | 2.2 | 44% | 491 | B | — |
| 35 | 36.1 | 1.6 | 45% | 487 | B | — |
| 36 | 32.0 | 2.3 | 44% | 473 | B | — |
| 37 | 35.3 | 1.6 | 45% | 509 | B | — |
| 38 | 32.0 | 1.9 | 42% | 471 | B | — |
| 39 | 35.1 | 1.8 | 51% | 445 | B | — |

TABLE 11

[Example of the Present Invention]

| | Microstructure | | Evaluation | | | |
|---|---|---|---|---|---|---|
| | CI value | Average | Electric | | Anti-SR characteristic | |
| No. | (ratio of CI value of 0.1) (%) | crystal grain diameter (μm) | conductivity (% IACS) | Proof stress (MPa) | 2-20Zn evaluation | 20-30Zn evaluation |
| 40 | 64.6 | 0.8 | 21% | 684 | — | A |
| 41 | 68.2 | 1.5 | 23% | 672 | — | A |

TABLE 11-continued

[Example of the Present Invention]

| | Microstructure | | Evaluation | | | |
|---|---|---|---|---|---|---|
| | CI value | Average | Electric | | Anti-SR characteristic | |
| No. | (ratio of CI value of 0.1) (%) | crystal grain diameter (μm) | conductivity (% IACS) | Proof stress (MPa) | 2-20Zn evaluation | 20-30Zn evaluation |
| 42 | 67.2 | 1.4 | 25% | 632 | A | — |
| 43 | 49.7 | 1.5 | 30% | 564 | A | — |
| 44 | 48.8 | 2.2 | 31% | 547 | A | — |
| 45 | 66.7 | 1.7 | 27% | 614 | A | — |
| 46 | 48.1 | 2.5 | 37% | 485 | A | — |
| 47 | 67.4 | 1.4 | 23% | 671 | — | A |
| 48 | 68.2 | 1.5 | 27% | 640 | A | — |
| 49 | 60.5 | 1.5 | 30% | 601 | A | — |
| 50 | 67.7 | 1.2 | 36% | 501 | A | — |
| 51 | 65.4 | 2.1 | 35% | 540 | A | — |
| 52 | 49.5 | 2.6 | 29% | 552 | A | — |
| 53 | 60.7 | 2.5 | 35% | 537 | A | — |
| 54 | 62.1 | 2.4 | 35% | 535 | A | — |
| 55 | 64.8 | 2.3 | 31% | 582 | A | — |
| 56 | 48.1 | 2.2 | 31% | 586 | A | — |
| 57 | 64.3 | 2.4 | 32% | 554 | A | — |
| 58 | 55.2 | 2.3 | 32% | 559 | A | — |

TABLE 12

[Comparative Example]

| | Microstructure | | Evaluation | | | |
|---|---|---|---|---|---|---|
| | CI value | Average | Electric | | Anti-SR characteristic | |
| No. | (ratio of CI value of 0.1) (%) | crystal grain diameter (μm) | conductivity (% IACS) | Proof stress (MPa) | 2-20Zn evaluation | 20-30Zn evaluation |
| 101 | 13.0 | 115 | 24% | 325 | — | A |
| 102 | 28.0 | 2.7 | 26% | 520 | — | C |
| 103 | 21.6 | 1.0 | 25% | 644 | — | C |
| 104 | 19.1 | 0.9 | 25% | 591 | — | C |
| 105 | 13.7 | 17 | 25% | 443 | — | B |
| 106 | 30.1 | 2.9 | 34% | 493 | C | — |
| 107 | 29.0 | 3.7 | 32% | 504 | C | — |
| 108 | 32.6 | 3.2 | 32% | 511 | C | — |
| 109 | 27.4 | 1.0 | 31% | 553 | C | — |
| 110 | 30.5 | 0.8 | 31% | 560 | C | — |
| 111 | 28.6 | 12 | 32% | 467 | B | — |
| 112 | 39.8 | 3.7 | 54% | 427 | C | — |
| 113 | 37.6 | 4.0 | 45% | 442 | C | — |
| 114 | 35.5 | 3.5 | 43% | 451 | C | — |
| 115 | 34.5 | 1.9 | 43% | 474 | C | — |
| 116 | 36.7 | 1.9 | 43% | 477 | C | — |
| 117 | 38.9 | 14 | 44% | 405 | B | — |
| 118 | 37.1 | 5.3 | 63% | 404 | C | — |

TABLE 13

| | Precipitate volume ratio (%) | | |
|---|---|---|---|
| No. | 10-100 nm | 1-10 nm | Classification |
| 4 | 0.06 | 0.05 | Example of the present invention |
| 5 | 0.07 | 0.05 | Example of the present invention |
| 13 | 0.08 | 0.07 | Example of the present invention |
| 17 | 0.09 | 0.05 | Example of the present invention |
| 18 | 0.07 | 0.06 | Example of the present invention |

Next, evaluation results of each sample are explained.

Nos. 1 to 17 are Examples of the present invention based on Cu-30Zn alloy containing Zn at around 30%. No. 18 is Example of the present invention based on Cu-25Zn alloy containing Zn around 25%. No. 19 is Example of the present invention based on Cu-20Zn alloy containing Zn around 20%. Nos. 20 to 28 are Examples of the present invention based on Cu-15Zn alloy containing Zn at around 15%. No. 29 is Example of the present invention based on Cu-10Zn alloy containing Zn around 10%. Nos. 30 to 38 are Examples of the present invention based on Cu-5Zn alloy containing Zn at around 5%. No. 39 is Example of the present invention based on Cu-3Zn alloy containing Zn around 3%. No. 40 is Example of the present invention based on Cu-30Zn alloy containing Zn around 30%. No. 41 is Example of the present invention based on Cu-20-25Zn alloy containing Zn 20 to 25%. No. 42 is Example of the present invention based on Cu-15Zn alloy containing Zn around 15%. Nos. 43 to 45 are Examples of the present invention based on Cu-5-10Zn alloy containing Zn at 5-10%. No. 46 is Example of the present invention based on Cu-3Zn alloy containing Zn around 3%. No. 47 is Example of the present invention based on Cu-20-25Zn alloy containing Zn 20 to 25%. No. 48 is Example of the present invention based on Cu-15Zn alloy containing Zn around 15%. No. 49 is Example of the present invention based on Cu-5-10Zn alloy containing Zn 5-10%. No. 50 is Example of the present invention based on Cu-3Zn alloy containing Zn around 3%. Nos. 51 to 54 are Examples of the present invention based on Cu-5Zn alloy containing Zn at around 5%. Nos. 55 to 58 are Examples of the present invention based on Cu-10Zn alloy containing Zn at around 10%.

Also, No. 101 is Comparative Example based on Cu-30Zn containing Zn around 30% and the average crystal grain diameter exceeded the upper limit defined in the present invention. Nos. 102 to 105 are Comparative Examples based on Cu-30Zn alloy. Nos. 106 to 111 are Comparative Examples based on Cu-15Zn alloy containing Zn around 15%. Nos. 112 to 117 are Comparative Examples based on Cu-5Zn alloy containing Zn around 5%. No. 118 is Comparative Example based on Cu-3Zn alloy containing Zn around 3%.

As shown in Tables 9 to 11, SR resistance was excellent in Examples Nos. 1 to 58, in which the content amounts of each element was in the range defined in the present invention and the content ratio among the elements were in the range defined in the present invention. Also, conductivity was 20% IACS or more. Thus, they are capable of being utilized for connectors and other terminal components sufficiently. Furthermore, it was confirmed that proof stress was not particularly inferior relative to the conventional materials.

On the other hand, in Comparative Examples no. 101 to 118, either one of SR resistance or strength (proof stress) was inferior relative to Examples of the present invention as shown in Table 12.

More specifically, in Comparative Example No. 101, proof stress was inferior since the average crystal grain diameter was large and exceeded 50 μm.

Also, in Comparative Example No. 102, the alloy was Cu-30Zn-based alloy in which Sn, Ni, Fe, and P were not added, and SR resistance was inferior, in addition to the low proof stress, relative to Example of the present invention based on Cu-30Zn alloy.

In Comparative Example No. 103, the alloy was Cu-30Zn-based alloy in which the content ratios (Ni+Fe)/P and Sn/(Ni+Fe), in addition to the ratio Fe/Ni, were off from the range defined in the present invention.

In Comparative Example No. 104, the alloy was Cu-3Zn-based alloy in which the Fe/Ni ratio was off from the range defined in the present invention. In this case, SR resistance was inferior.

In Comparative Example No. 105, the alloy was Cu-30Zn-based alloy in which the Fe/Ni ratio was off from the range defined in the present invention. In this case, proof stress was inferior relative to Example of present invention based on Cu-30Zn alloy.

In Comparative Example No. 106, the alloy was Cu-15Zn-based alloy in which Sn, Ni, Fe, and P were not added. In this case, SR resistance in addition to proof stress was inferior relative to Example of the present invention based on Cu-15Zn alloy.

In Comparative Example No. 107, the alloy was Cu-15Zn-based alloy in which Ni, Fe, and P were not added. In this case, SR resistance in addition to proof stress was inferior relative to Example of the present invention based on Cu-15Zn alloy.

In Comparative Example No. 108, the alloy was Cu-15Zn-based alloy in which Ni and Fe were not added. In this case, SR resistance in addition to proof stress was inferior relative to Example of the present invention based on Cu-15Zn alloy.

In Comparative Example No. 109, the alloy was Cu-15Zn-based alloy in which the content ratios (Ni+Fe)/P and Sn/(Ni+Fe), in addition to the ratio Fe/Ni, were off from the range defined in the present invention. In this case, SR resistance was inferior.

In Comparative Example No. 110, the alloy was Cu-15Zn-based alloy in which Fe/Ni ratio was off from the range defined in the present invention. In this case, SR resistance was inferior.

In Comparative Example No. 111, the alloy was Cu-15Zn-based alloy in which Fe was not added. In this case, proof stress was inferior relative to Example of the present invention based on Cu-15Zn alloy.

In Comparative Example No. 112, the alloy was Cu-5Zn-based alloy in which Sn, Ni, Fe, and P were not added. In this case, SR resistance in addition to proof stress was inferior relative to Example of the present invention based on Cu-5Zn alloy.

In Comparative Examples Nos. 113 and 114, the alloys were Cu-5Zn-based alloy in which Ni, Fe, and P were not added, and Cu-5Zn-based alloy in which Ni and Fe were not added, respectively. In these cases, SR resistance in addition to proof stress was inferior relative to Example of the present invention based on Cu-5Zn alloy.

In Comparative Example No. 115, the alloy was Cu-5Zn-based alloy in which the content ratio (Ni+Fe)/P, in addition to the ratio Fe/Ni, was off from the range defined in the present invention. In this case, SR resistance was inferior.

In Comparative Example No. 116, the alloy was Cu-5Zn-based alloy in which the content ratio Fe/Ni was off from the range defined in the present invention. In this case, SR resistance was inferior.

In Comparative Example No. 117, the alloy was Cu-5Zn-based alloy in which the content ratio (Ni+Fe)/P, in addition to the ratio Fe/Ni, was off from the range defined in the present invention. In this case, proof stress was inferior relative to Example of the present invention based on Cu-5Zn alloy.

In Comparative Example No. 118, the alloy was Cu-3Zn-based alloy in which Sn, Ni, Fe, and P were not added. In these cases, SR resistance in addition to proof stress was inferior relative to Example of the present invention based on Cu-3Zn alloy.

INDUSTRIAL APPLICABILITY

According to the present invention, a Cu—Zn—Sn-based copper alloy that has a high strength and other excellent properties, such as bendability, electric conductivity, and the like, can be provided. Also, a copper alloy part, such as a thin plate and the like made of the above-mentioned copper alloy, can be provided. The copper alloy can be used suitably for a connector, other terminals, a movable conductive piece of an electromagnetic relay, a part for an electronic/electric part for a lead frame or the like.

The invention claimed is:

1. A copper alloy for an electronic/electric device comprising:

in mass %, more than 3.4% and 36.5% or less of Zn; 0.1% or more and 0.9% or less of Sn; 0.05% or more and less than 1.0% of Ni; 0.001% or more and less than 0.10% of Fe; 0.005% or more and 0.10% or less of P; and the balance Cu and inevitable impurities, wherein a content ratio of Fe to Ni, Fe/Ni, in atomic ratio satisfies $0.002 \leq Fe/Ni < 1.5$, a content ratio of a sum of Ni and Fe, (Ni+Fe), to P, in atomic ratio satisfies $3 < (Ni+Fe)/P < 15$, a content ratio of Sn to a sum of Ni and Fe, (Ni+Fe), in atomic ratios satisfies $0.3 < Sn/(Ni+Fe) < 5$, an average crystal grain diameter of a phase containing Cu, Zn, and Sn is in a range of 0.1 to 50 μm, and the copper alloy includes a precipitate containing P and one or more elements selected from Fe and Ni.

2. The copper alloy for an electronic/electric device according to claim 1, wherein an average grain diameter of the precipitate containing P and one or more elements selected from Fe and Ni is 100 nm or less.

3. The copper alloy for an electronic/electric device according to claim 2, wherein a precipitation density of the precipitate containing P and one or more elements selected from Fe and Ni and having the average grain diameter of 100 nm or less is in a range of 0.001 to 1.0% in volume ratio.

4. The copper alloy for an electronic/electric device according to claim 3, wherein the precipitate containing P and one or more elements selected from Fe and Ni has a crystal structure of $Fe_2P$-based crystal or $Ni_2P$-based crystal structure.

5. The copper alloy for an electronic/electric device according to claim 1, wherein the copper alloy for electronic/electric device has a mechanical property such that 0.2% offset yield strength is 300 MPa or more.

6. A copper alloy thin plate for an electronic/electric device, the copper alloy thin plate being made of a rolled material of the copper alloy according claim 1, wherein a thickness of the copper alloy thin plate is in a range of 0.05 to 1.0 mm.

7. A conductive component for an electronic/electric device comprising a bended part made of the copper alloy thin plate for electronic/electric device according to claim 6, wherein the bended part is pressed to a coupling conductive part by spring property of the bended part to secure an electric conductivity to the coupling conductive part.

8. The terminal made of the copper alloy thin plate for an electronic/electric device according to claim 6.

9. The copper alloy thin plate for an electronic/electric device according to claim 6, wherein a surface of the thin plate is plated with Sn.

10. A conductive component for an electronic/electric device comprising a bended part made of the copper alloy thin plate for electronic/electric device according to claim 9, wherein the bended part is pressed to a coupling conductive part by spring property of the bended part to secure an electric conductivity to the coupling conductive part.

11. The terminal made of the copper alloy thin plate for an electronic/electric device according to claim 9.

12. The copper alloy for an electronic/electric device according to claim 1, wherein a content amount of Fe is 0.064% or less in mass %.

13. The copper alloy for an electronic/electric device according to claim 1, wherein the content ratio (Ni+Fe) to P, in atomic ratio satisfies $5.1 < (Ni+Fe)/P < 15$.

14. The copper alloy for an electronic/electric device according to claim 1, wherein the content ratio Fe/Ni, in atomic ratio satisfies $0.002 \leq Fe/Ni < 0.5$.

15. The copper alloy for an electronic/electric device according to claim 1, wherein the content amount of Zn is 32.5% or less in mass %.

16. The copper alloy for an electronic/electric device according to claim 1, wherein the content amount of Zn is 8.0 to 32.0% in mass %.

17. The copper alloy for an electronic/electric device according to claim 1, wherein the content amount of Zn is 4.0 to 36.5% in mass %.

18. A conductive component for an electronic/electric device comprising a bended part made of the copper alloy for electronic/electric device according to claim 1, wherein the bended part is pressed to a coupling conductive part by spring property of the bended part to secure an electric conductivity to the coupling conductive part.

19. A terminal made of the copper alloy for an electronic/electric device according to claim 1.

20. A copper alloy for an electronic/electric device comprising:

in mass %, more than 3.4% and 36.5% or less of Zn; 0.1% or more and 0.9% or less of Sn; 0.05% or more and less than 1.0% of Ni; 0.001% or more and less than 0.10% of Fe; 0.001% or more and less than 0.10% of Co; 0.005% or more and 0.10% or less of P; and the balance Cu and inevitable impurities, wherein a content ratio of a sum of Fe and Co, (Fe+Co), to Ni, (Fe+Co)/Ni, in atomic ratio satisfies $0.002 \leq (Fe+Co)/Ni < 1.5$, a content ratio of a sum of Ni, Fe, and Co, (Ni+Fe+Co), to P, in atomic ratio satisfies $3 < (Ni+Fe+Co)/P < 15$, a content ratio of Sn to a sum of Ni, Fe, and Co, (Ni+Fe+Co), in atomic ratios satisfies $0.3 < Sn/(Ni+Fe+Co) < 5$, an average crystal grain diameter of α phase containing Cu, Zn, and Sn is in a range of 0.1 to 50 μm, and the copper alloy includes a precipitate containing P and one or more elements selected from Fe, Ni, and Co.

21. The copper alloy for an electronic/electric device according to claim 20, wherein an average grain diameter of the precipitate containing P and one or more elements selected from Fe, Ni, and Co is 100 nm or less.

22. The copper alloy for an electronic/electric device according to claim 21, wherein a precipitation density of the precipitate containing P and one or more elements selected from Fe, Ni, and Co, and having the average grain diameter of 100 nm or less is in a range of 0.001 to 1.0% in volume ratio.

23. The copper alloy for an electronic/electric device according to claim 20, wherein the precipitate containing P and one or more elements selected from Fe, Ni, and Co has a crystal structure of $Fe_2P$-based crystal or $Ni_2P$-based crystal structure.

24. The copper alloy for an electronic/electric device according to claim 20, wherein a content amount of Fe is 0.064% or less in mass %.

25. The copper alloy for an electronic/electric device according to claim 20, wherein the content ratio (Ni+Fe+Co) to P, in atomic ratio satisfies $5.1 \leq (Ni+Fe+Co)/P < 15$.

26. The copper alloy for an electronic/electric device according to claim 20, wherein the content ratio (Fe+Co)/Ni, in atomic ratio satisfies $0.002 \leq (Fe+Co)/Ni < 0.5$.

27. The copper alloy for an electronic/electric device according to claim 20, wherein the content amount of Zn is 32.5% or less in mass %.

28. The copper alloy for an electronic/electric device according to claim 20, wherein the content amount of Zn is 8.0 to 32.0% in mass %.

* * * * *